US007124918B2

(12) United States Patent
Rascoe

(10) Patent No.: US 7,124,918 B2
(45) Date of Patent: Oct. 24, 2006

(54) BEADING TOOL AND METHOD

(76) Inventor: Jodi Rascoe, 1010 First St., Hermosa Beach, CA (US) 90254

( * ) Notice: Subject to any disclaimer, the term of this patent is extended or adjusted under 35 U.S.C. 154(b) by 298 days.

(21) Appl. No.: 10/645,731

(22) Filed: Aug. 18, 2003

(65) Prior Publication Data

US 2004/0216758 A1 Nov. 4, 2004

Related U.S. Application Data

(60) Provisional application No. 60/467,969, filed on May 4, 2003.

(51) Int. Cl.
*A41H 43/00* (2006.01)

(52) U.S. Cl. ..... 223/48

(58) Field of Classification Search ..... 223/1, 223/44, 48, 99, 102, 104, 50, 105; 132/200, 132/207, 212, 273, 275; 119/83, 85
See application file for complete search history.

(56) References Cited

U.S. PATENT DOCUMENTS

| | | | | |
|---|---|---|---|---|
| 2,688,816 | A | 9/1954 | Bondesen | |
| 3,133,345 | A * | 5/1964 | Shaw | 29/433 |
| 3,545,069 | A | 12/1970 | Krieger | |
| 4,102,470 | A | 7/1978 | Timmons | |
| 4,280,266 | A | 7/1981 | Tomita et al. | |
| 4,307,908 | A | 12/1981 | Donaldson | |
| 4,315,362 | A | 2/1982 | Pigford et al. | |
| 4,779,616 | A | 10/1988 | Johnson | |
| 4,850,131 | A | 7/1989 | Standish, Jr. | |
| 5,197,175 | A | 3/1993 | Yuen | |
| 5,279,255 | A | 1/1994 | Northcutt | |
| 5,289,834 | A | 3/1994 | Lawrence | |
| 5,395,245 | A | 3/1995 | Heinz | |
| 5,404,892 | A | 4/1995 | Bretl | |
| 5,417,230 | A | 5/1995 | Wood | |
| 5,456,271 | A | 10/1995 | Legette | |
| 5,488,963 | A * | 2/1996 | Fishman | 132/212 |
| 5,558,105 | A | 9/1996 | Rosenwinkel et al. | |
| 5,664,707 | A | 9/1997 | Spector | |
| 5,687,751 | A | 11/1997 | Villani | |
| 5,775,341 | A | 7/1998 | Abe et al. | |
| 5,806,538 | A | 9/1998 | Keltner | |
| 5,810,022 | A * | 9/1998 | Reynolds | 132/200 |
| 5,832,938 | A | 11/1998 | Ybarra | |
| 5,881,736 | A * | 3/1999 | Turner et al. | 132/200 |
| 5,881,738 | A | 3/1999 | Villani | |
| 5,967,151 | A | 10/1999 | Villani et al. | |
| 6,016,813 | A | 1/2000 | Kennedy | |
| 6,035,864 | A * | 3/2000 | Kennedy | 132/273 |
| 6,439,000 | B1 | 8/2002 | Smark | |
| 6,637,441 | B1 * | 10/2003 | Kennedy et al. | 132/212 |

FOREIGN PATENT DOCUMENTS

| | | |
|---|---|---|
| JP | 59-133293 | 7/1984 |
| WO | WO 89/09551 | 10/1989 |

* cited by examiner

*Primary Examiner*—Gary L. Welch
(74) *Attorney, Agent, or Firm*—Blakely Sokoloff Taylor & Zafman

(57) ABSTRACT

A device including a rod having an end portion and a hooked portion is presented. The end portion and the hooked portion are located at opposite ends of the rod. A support is connected to the rod. The support includes a many rod guides. The hooked portion is adapted to string filamentous material through at least one bead that has a thru-hole.

63 Claims, 20 Drawing Sheets

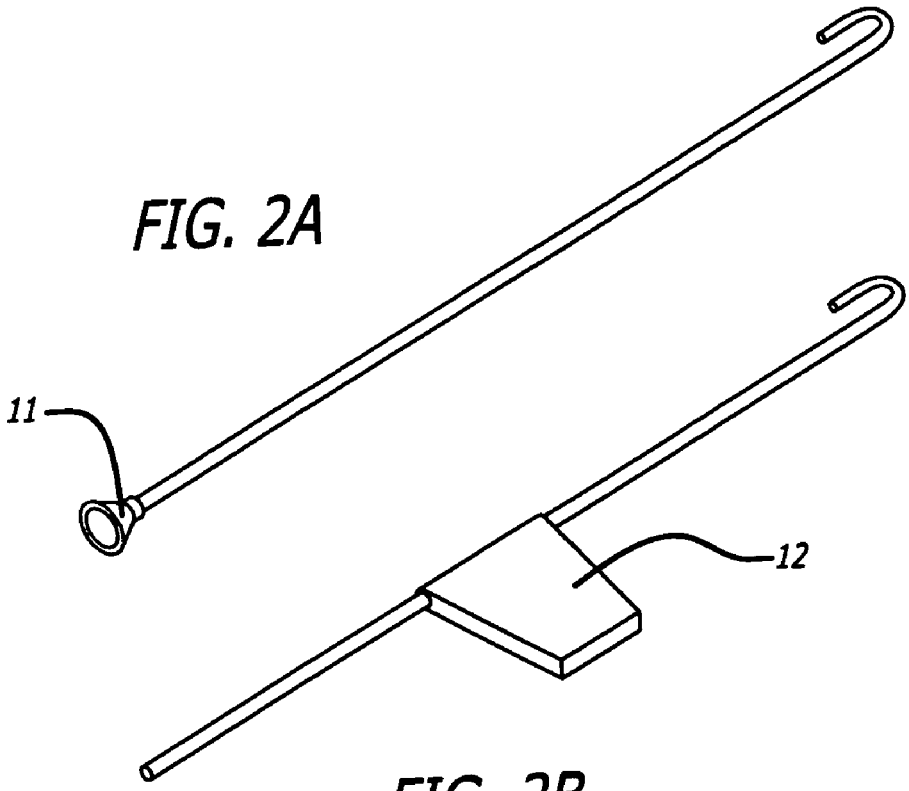
FIG. 2A
FIG. 2B
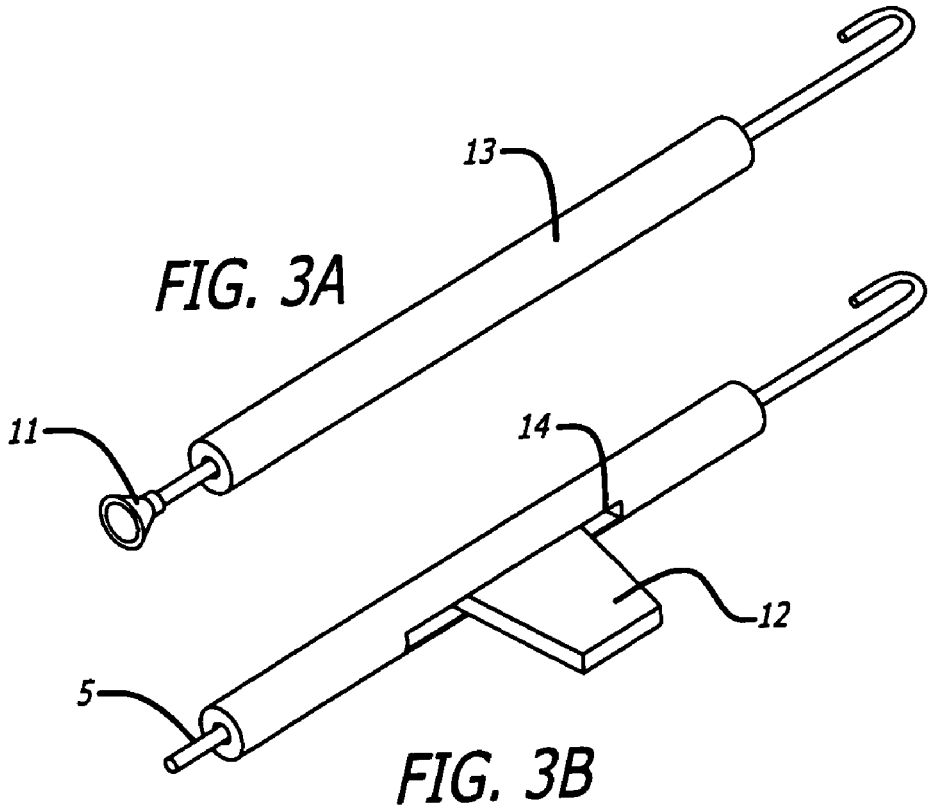
FIG. 3A
FIG. 3B

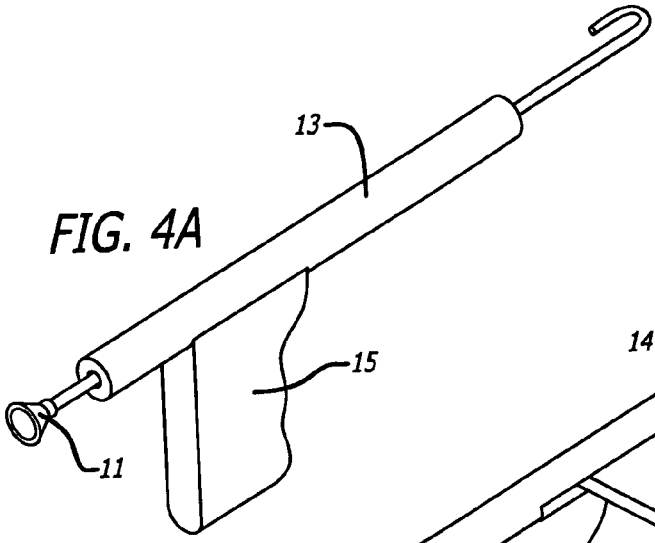
FIG. 4A
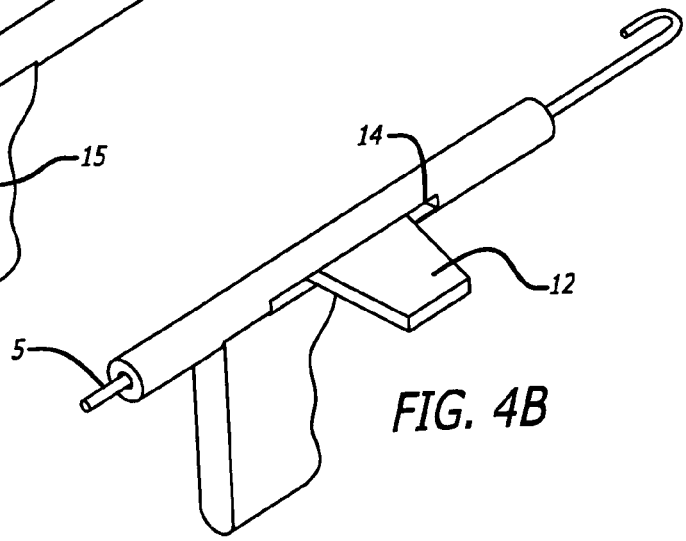
FIG. 4B
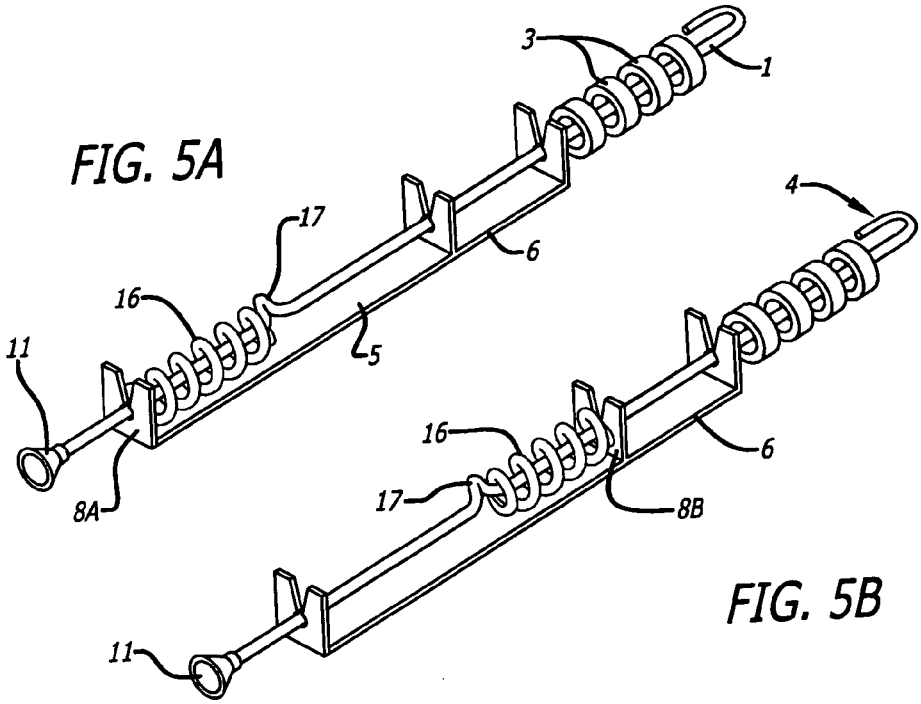
FIG. 5A
FIG. 5B

BEADING TOOL AND METHOD

This application claims the priority of U.S. Provisional Patent Application No. 60/467,969, filed May 4, 2003, entitled BEADING TOOL AND METHOD.

BACKGROUND

1. Field

The embodiments relate to an improved beading tool and method for stringing beads on hair, string, or the like.

2. Description of the Related Art

The prior art beading tools all have long and narrow exposed hooks or loops, or long narrow tubes with enclosed short hooks of various configurations that fit in the holes of a row of beads. Hair or string is placed in the hook or loop, and the beads are pushed off the hook or loop by hand onto the hair or string, with the folded over hair or string being held by the hook or loop as the beads slide over it, thus stringing the beads. Such an action is slow, and the fragile nature of the exposed long narrow construction necessary to pass through the bead holes makes it unsafe for children. The lengthy size of these tools is somewhat unwieldy, especially for a child, and gives them a flimsy appearance.

BRIEF DESCRIPTION OF THE DRAWINGS

Various features, aspects and advantages will become more thoroughly apparent from the following detailed description, the set claims, and accompanying drawings in which:

FIG. 2*a* is a perspective view of an embodiment having a handle at its end.

FIG. 2*b* is a perspective view of an embodiment with the hook and having a handle along its side.

FIG. 3*a* is a perspective view of an embodiment having the hook support including a tube with a hook with a handle at its end.

FIG. 3*b* is a perspective view of an embodiment having the hook support as a tube with a hook with a handle along its side.

FIG. 4*a* is a perspective view of the embodiment illustrated in FIG. 3*a* having a pistol grip handle.

FIG. 4*b* is a perspective view of the embodiment illustrated in FIG. 3*b* having a pistol grip handle.

FIG. 5*a* is a perspective view of the embodiment illustrated in FIG. 1 having a spring biasing the hook outward from the hook support.

FIG. 5*b* is a perspective view of the embodiment illustrated in FIG. 1 having a spring biasing the hook inward.

DETAILED DESCRIPTION

Figure 1A:
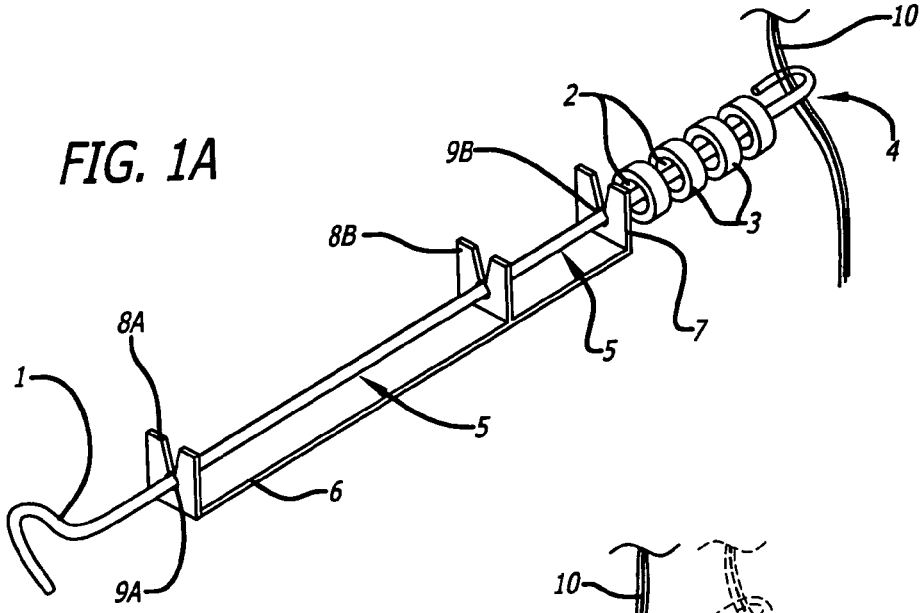
FIG. 1*a* is a perspective view of an embodiment as hair is just being hooked.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an " element, that does not mean there is only one of the element. If the specification or claims refer to "an additional" element, that does not preclude there being more than one of the additional element.

While the invention can have many embodiments, in its most basic form the beading tool as seen in FIG. 1 includes: elongate hook 1 of a rigid or semi-rigid material, such as plastic or metal narrow enough to fit in hole 2 in the center of a bead(s) 3, the hook includes a short hooked portion 4 attached to an elongate rod portion 5 which may be either straight or curved, and an elongate hook support 6 of a rigid or semi-rigid material, such as plastic in which the hook is slidably mounted so as to be extendable therefrom and including a bead stop portion 7 adjacent to the end portion of the rod holding the hook portion, spaced apart rod guide portions 8*a* and 8*b* each having therein rod guiding apertures 9*a* and 9*b*, respectively.

In one embodiment, a process of using an embodiment of a beading tool includes sliding one or more beads over the hook (e.g., hook 1), hooking the hook over a section of filamentous material, such as hair, string, etc., and withdrawing the hook with the filamentous material through the bead or beads, where the beads rest against the bead stop. The term "Bead" as used in this specification most typically refers to a decorative object with a hole in it for the purpose of stringing on a section of filamentous material, but can also be any type of object with a hole for stringing, such as a ring, perforated disk, perforated card, key, or other object. When the hook has moved past the last bead, which has been stopped from moving along with the hook by resting against the bead stop, the filamentous material will be threaded through the bead or beads and can be withdrawn from the hook with the beads threaded on it. This process is illustrated in FIG. 1.

Figure 1B:
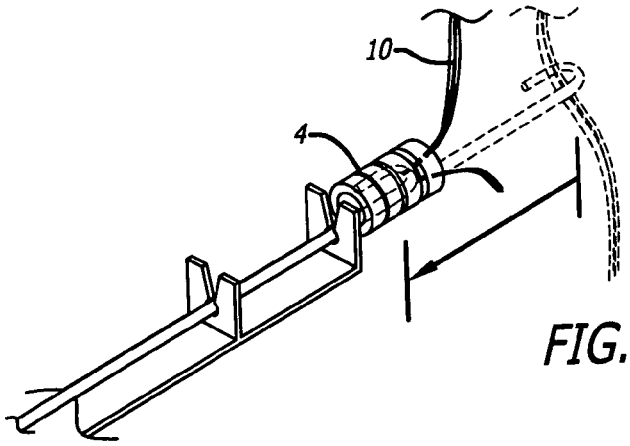
FIG. 1*b* is a perspective view of an embodiment showing the hair being hooked and sliding through the row of beads.
Figure 1C:
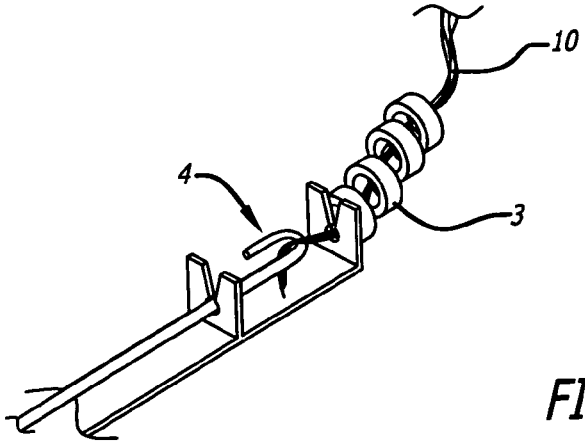
FIG. 1*c* is a perspective view of an embodiment showing the beads fully strung on the hair.

FIG. 1*a* illustrates the beads 3 slidably mounted on rod portion 5 of hook 1, with the end of a filamentous material portion 10 hooked in the hook portion 4 of hook 1. In FIG. 1*b*, hook portion 4 with the hooked filamentous material 10 has been partially drawn through the beads 3. In FIG. 1*c*, the hook portion 4 has been withdrawn through the beads 3 along with the filamentous material 10, leaving beads 3 threaded. Withdrawing the hook through the beads can be done very quickly, giving the impression of almost instantaneous threading for improved entertainment value.

It can be seen that within the basic concept of the embodiments thus described, many variations to the part sizes and dimensions can be made without altering the basic nature of the device or method. For instance, FIG. 2*a* illustrates one embodiment having handle 11 added to the end of the hook to make grasping the hook by a user more convenient. FIG. 2*b* illustrates an embodiment having tab portion 12 added to the side of the hook to make grasping the hook by a user more convenient.

FIG. 3 illustrates an embodiment where the bead stop portion and the rear guide aperture have been made in the form of rings and connected with a cylinder, forming one long cylinder 13 having the same essential form and function as the hook support 6 illustrated in FIG. 1. FIG. 3*a* also illustrates handle 11 in the form of round knob attached to the unhooked end of hook rod 5, and FIG. 3*b* illustrates an embodiment having a tab attached to hook rod 5 and protruding from slot 14 in cylinder 13.

FIG. 4*a* illustrates an embodiment having a pistol-type grip handle 15 attached to the rod for more convenient grasping and additionally illustrates the handle 11 attached to the rear of hook rod 5.

FIG. 4*b* illustrates pull-tab 12 attached to the side of hook rod 5 and protruding from slot 14 in cylinder 13.

FIG. 5 illustrates one embodiment having a spring is added to bias the hook to either an extended or retracted position in the hook holder. As illustrated in FIG. 5*a*, a compression spring 16 is located coaxially along hook rod 5, with one end resting against the rear hook guide portion 8*a* and the other pressing against a unshaped bend 17 in hook rod 5. Pulling on handle 11 retracts the hook into hook support 6 and compresses spring 16. When released, spring 16 biases hook 1 outwardly from hook support 6 and makes it more convenient to slide beads 3 along the end of the hook 1.

FIG. 5*b* illustrates an embodiment where spring 16 is located coaxially along the hook rod 5, but one end rests against u-shaped bend 17 in hook rod 5 and the other rests against rod guide portion 8*b*, thus biasing hook 1 inward toward hook support 6. When handle 11 is pushed inward by a user, spring 16 is compressed and the hooked end 4 of hook 1 extends outward from hook support 6. Thus hooked end 4 is normally stored in hook support 6 protecting it from damage. It is understood by one skilled in the art that any number of similar arrangements may be made to function similarly, such as by incorporating tension or torsion springs, by locating springs alongside hook 1 instead of coaxially and attaching them to hook 1 by any number of conventional means, etc.

Figure 6:
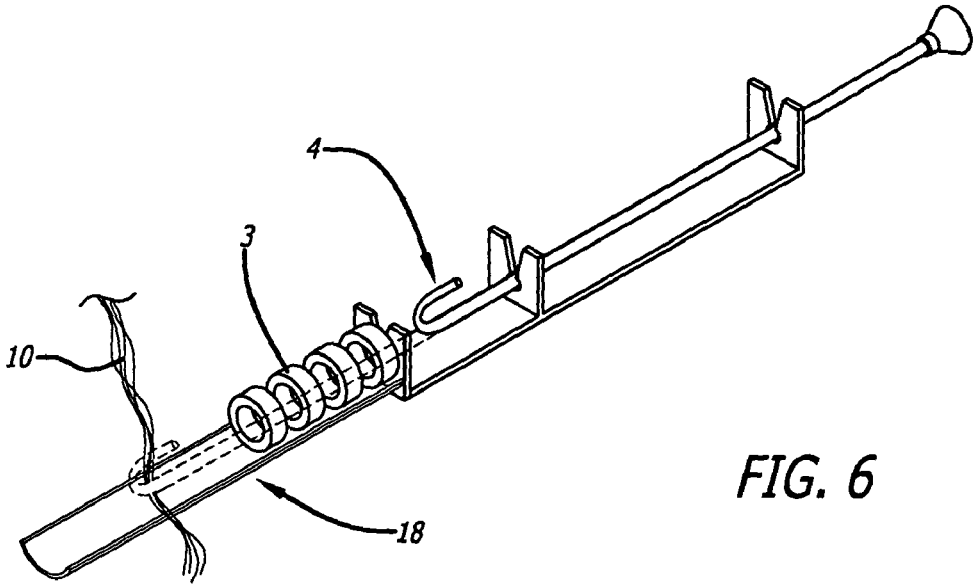
FIG. 6 is a perspective view of the embodiment illustrated in FIG. 1 having a bead rest at the hook end.

FIG. 6 illustrates one embodiment including a bead support section outboard and directly under the outboard end of the hook. As illustrated in FIG. 6, bead support section 18 is a trough-shaped portion of a rigid or semi-rigid material sized and located to hold beads 3 along their outer rim in a row in a position such that the hook can be slidably inserted into holes 2 in the row of beads as they are resting in the bead support section. In this embodiment, the beading method begins by first arranging beads 3 in a row in bead support section 18, then sliding hook portion 4 forward and through lined-up apertures 2 in the row of beads, hooking the filamentous material 10 and withdrawing the hook and filamentous material back through the beads. Thus, threading the beads. This beading method allows various beads to be arranged and rearranged one at a time in an aesthetically pleasing order prior to stringing, without removing other beads as would be necessary if the beads were aligned on the hook prior to stringing. The bead support section also can function as a protective shield for the extended length of hook to prevent damage, such as bending, etc.

Figure 7:
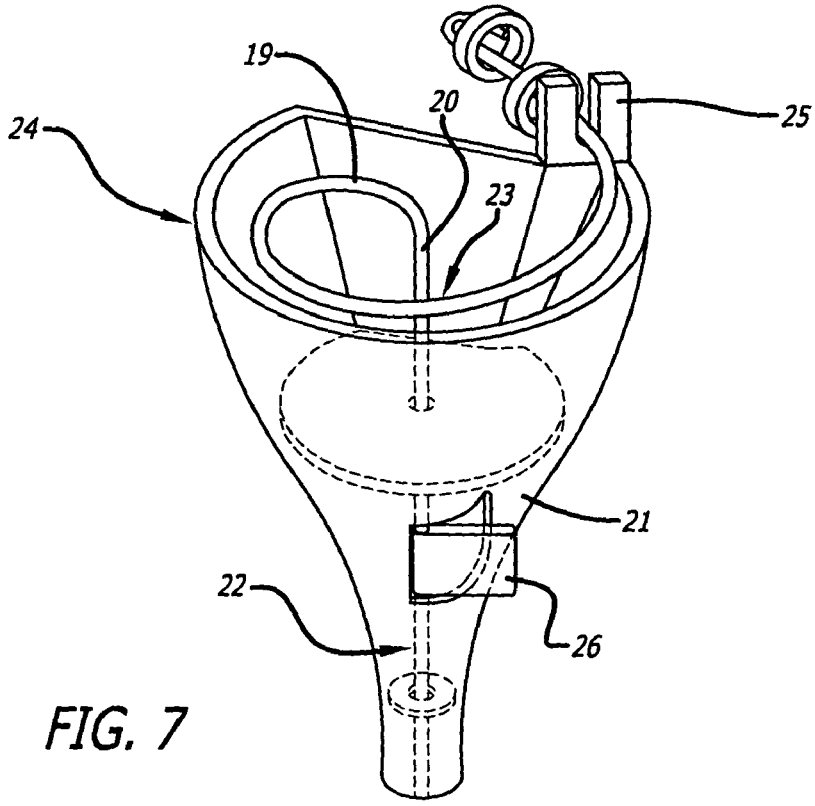
FIG. 7 is a perspective view of an embodiment having a curved hook.

FIG. 7 illustrates an embodiment where hook 19 is curved into a portion of a circle portion 23 and attached to a rod portion 20 that bends at a right angle to the plane of circle portion 23 and extends along the axis of the center of the circle portion. Hook 19 is mounted in hook support 21 so axis portion 22 of hook 19 is rotatable within hook support 21, which is made of a rigid or semi-rigid material, such as plastic, and shaped like a funnel with circle portion 23 of hook 19 approximately coplanar with large funnel end 24. A portion of funnel end 24 is cut away so that hook end can extend out from the funnel sides to allow beads to be strung onto it. Hook 1 extends out from funnel end 24 through bead stop 25. Attached to vertical axis portion 22 of hook 19, and protruding from hook support 21 through a slot, is tab 26 that pushes the hook in a rotating manner to extend it from the hook support. In other embodiment, a trigger or button can be incorporated in the place of tab 26 and connected by any number of conventional means to hook 21 to perform the same function as tab 26.

Figure 8:
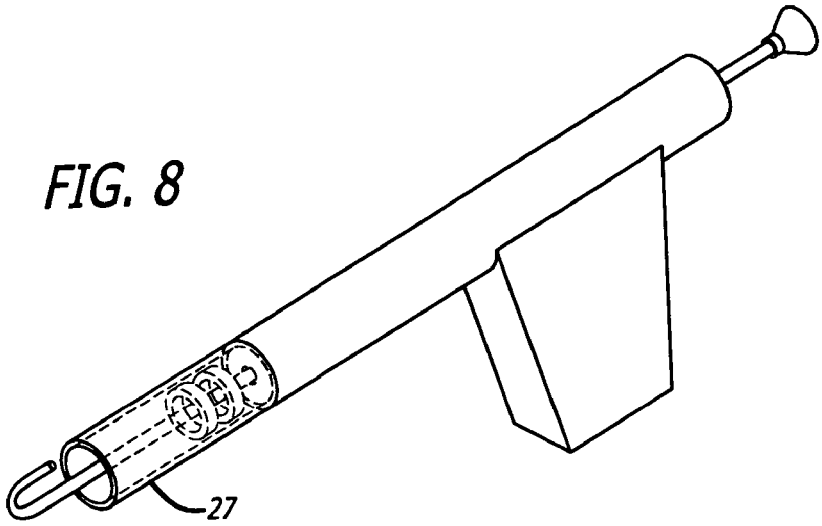
FIG. 8 is a perspective view of the embodiment illustrated in FIG. 4 having a rod cover.

FIG. 8 illustrates an embodiment including a rigid or semi rigid part that extends over a substantial portion of the hook in its extended position to shield it from damage that may occur due to the fragile nature of its slim and extended shape necessary to fit through a plurality of beads. As seen in FIG. 8, rod cover 27 is preferably a somewhat cylindrical tube large enough to fit around the exterior of the beads and long enough to cover the extended hook with just the tip of the hook portion uncovered. In one embodiment, rod cover 27 is transparent or translucent to allow viewing of the beads. The exact shape of the cover is not important as long as a substantial portion of the hook extended portion is enclosed or partly enclosed so that some protection will be afforded to the hook, as for instance from dropping this embodiment of a beading tool. In another embodiment rod cover 27 is a portion of a cylinder.

Figure 9:
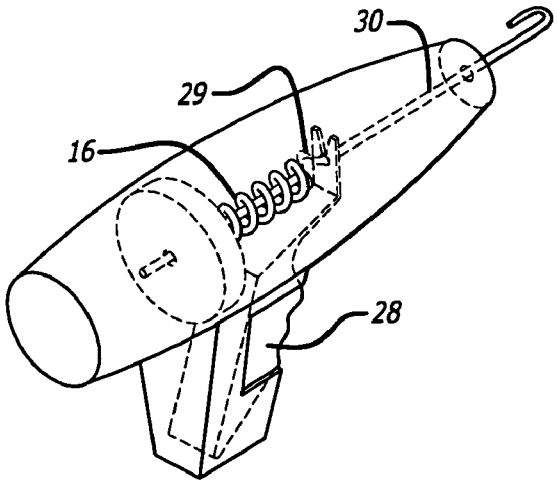
FIG. 9 is a perspective view of an embodiment having a direct-pushing trigger activation.

FIG. 9 illustrates an embodiment having trigger activation. The trigger activation to the hook acts to retract or extend the hook, thus enabling one-handed operation during the threading part of the beading process. Many common methods may be used to connect the trigger to the hook and move it, such as pushing it directly, connecting it via a part such as a rod, or using a gear system, and it is understood that the exact method is not important but rather may be chosen for its ease of use within the particular outer form of the hook support that may be used. As illustrated in FIG. 9, within the handle portion trigger 28 is shown with an upwardly extending rigid portion pressing rearward against stop portion 29 affixed to hook rod 30. The hook is biased forwardly by compression spring 16 as shown, which also pushes against and biases forwardly trigger 28. When trigger 28 is pushed rearward, it pushes against hook stop portion 29 and compresses spring 16 as it moves rearward. When released, hook rod 30 moves forward and the attached hook stop 29 pushes trigger 28 forward. Other variations of this arrangement are of course possible and do not materially affect its function, such as attaching the spring to the trigger instead of the hook.

Figure 10:
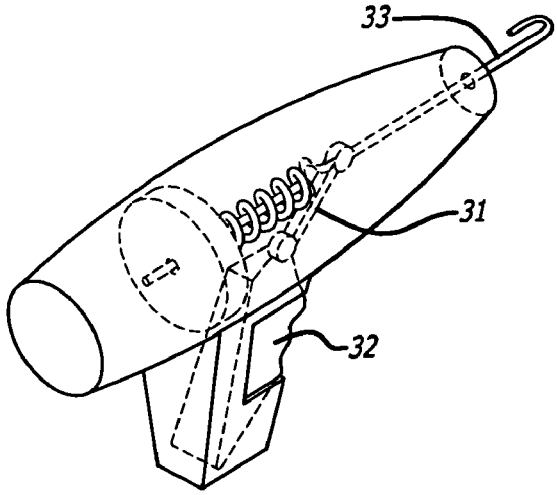
FIG. 10 is a perspective view of an embodiment having linkage connected trigger activation.

FIG. 10 illustrates an embodiment having link 31 connecting trigger 32 and hook rod 33. In one embodiment link 31 can be rigid and connected pivotally to the rod and trigger as shown, and can be used to pull (as shown) or push. In another embodiment link 31 can be flexible and activated in tension.

Figure 11:
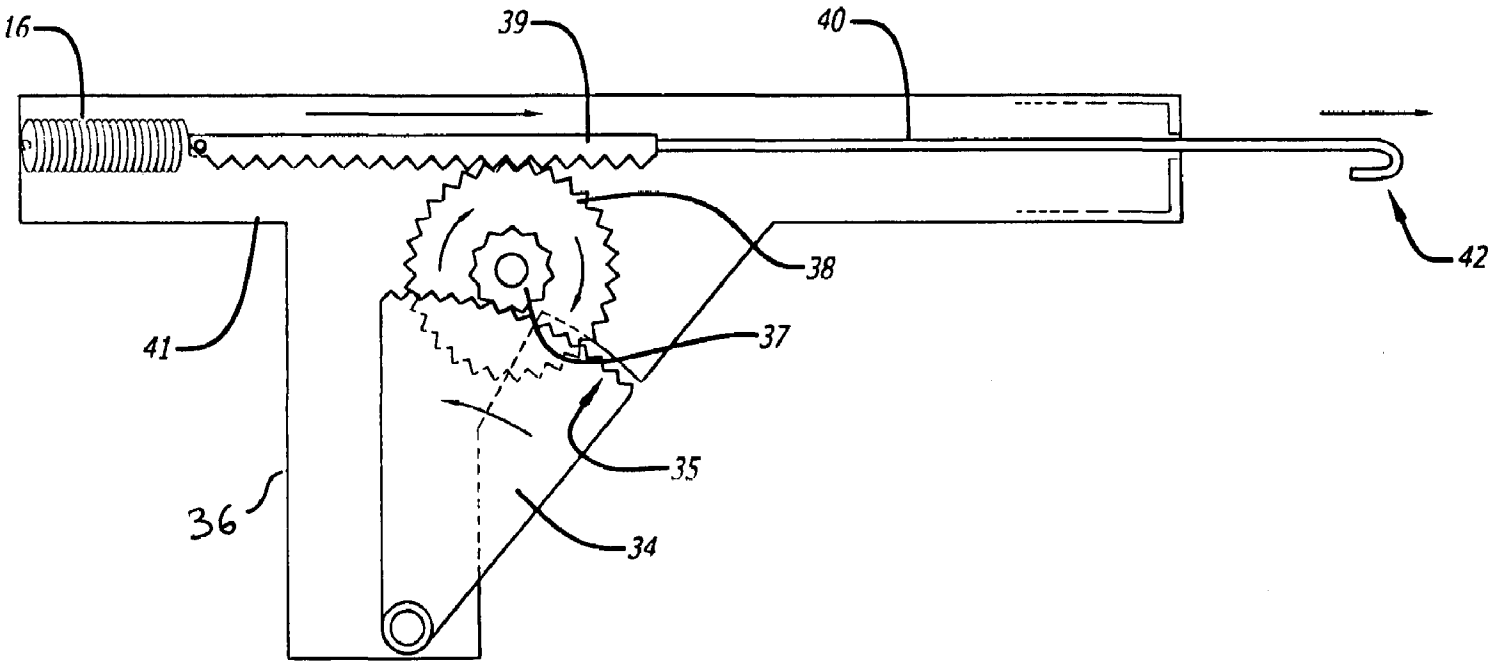
FIG. 11 is a perspective view of an embodiment having geared trigger activation.

FIG. 11 illustrates an embodiment including a gear and rack system where the length of trigger pull is amplified, pushing or pulling the hook a greater distance than the trigger is pulled, allowing a shorter trigger pull for a given distance of hook travel than otherwise possible. Referring to FIG. 11, trigger 34 has gear section 35 along its upper edge and is pivotally mounted to handle 36 at the gear section's center point at the lower end of the trigger. Gear section 35 engages pinion 37 coaxially mounted on a larger gear 38 mounted rotatably in the housing near the upper end of handle 36. The larger gear 38 engages rack 39 mounted slidingly in hook support 41 and collinearly along hook rod 40. Spring 16 biases hook rod 40 rearward. When activated, the trigger gear portion moves rearward, engaging pinion 37 and turning it and it's attached gear 38 clockwise as viewed. Gear 38 engages rack 39, which with its attached hook 42 slides forward, enabling beads to be attached as previously described. When released, spring 16 pulls the rack rearward and thus rotates the gear 38 and pinion 37 counterclockwise, which pushes gear section 35 and trigger 34 forward.

In another embodiment movement of the bead stop portion relative to the handle portion is included, thus increasing the relative movement of the bead stop relative to the hook for a particular distance of trigger action. This embodiment is described below. FIGS. 12*a*, 12*b*, 12*c*, and 12*d* illustrate an embodiment including an elongate hook 43 similar to that previously described, except that it has a "unshaped" bend 44 near the interior end and two short 90 degree bends 45 and 46 at the interior end for the purpose of snapping onto a gear rack 47. Hook 43 is preferably made of metal. Gear rack 47 is approximately one quarter the length of hook 43, and is preferably made of plastic, with its teeth facing downward. Along the length of each side of gear rack 47 is slot 48. Partially enclosing hook 43 is bead stop 49, consisting of a cylindrical portion 50 coaxial to hook 43, and a spine portion 51 extending axially from the end of the cylindrical portion and along the length of which are located two slots 52, one per side, and gear rack portion 53 along spine portion 51 with its teeth facing downward. Gear rack 47 along with its attached hook 43 and bead stop 49 are slidingly coupled between the halves of housings 54 and 55, which function as both a hook support and handle as well as holding the other parts. The slots 48 and 52 of the rack 47 and bead stop 49 fit between raised, opposed pairs of ribs 56A and 56B and 57A and 57B on the opposing interior sides of housing halves 54 and 55, and can slide lengthwise along the ribs.

Viewed on end, rack 47 and rack portion 53 are displaced slightly laterally and vertically from each other so that they may both engage spur gears 58 and 59, which are slightly displaced from a coplanar relationship as they engage each other. Gear 59 is rotationally mounted on an axle 60 perpendicularly attached to the interior wall of housing half 54 such that it simultaneously engages rack portion 53 and gear 58. Gear 58, which is integral with pinion 61, is rotationally mounted to an axle 62 attached to housing half 55.

Trigger 63A is pivotally mounted at its top corner on an axle 64 extending perpendicularly from the lower edge of housing 54 adjacent to the top forward edge of handle portion 65. Gear segment 66 attached to the inboard upper portion of trigger 63A such that its rotational center is at the center of axle 64. Trigger cover 63B attaches to trigger 63A. A spring 67 is pivotally mounted on an axle 68 extending perpendicular from the inner wall of the handle portion 65 and one end of spring 67 presses trigger 63A outward from handle portion 65 with the other end pressing against the inner rear wall of handle portion 65.

Hook cover top half 69 is approximately half-cylindrical in shape, and attached with conventional means, such as screws to a mating half-cylindrical bottom cover half 70. Cover top half 69 covers a substantial portion of assembled housing halves 54 and 55 and extends out over the hook end of the housing upper section and covers a substantial portion of the extended hook 43, thus protecting it from damage and making it safer to use. Cover bottom half 70 attaches to cover top half 69 forming an approximate cylinder shape extending outward from the end of the complete housing forward of trigger 63A.

In operation, the assembled tool is first grasped by the handle portion 65, with trigger 63A not depressed. Hook 43 will be in its most extended position with its hooked end extending beyond the cover end, and bead stop 49 will be in its most interior position, leaving a section of hook 43 of sufficient length to hold a plurality of beads mounted coaxially on it. A desired quantity of beads is placed on hook 43 by fitting hooked tip 71 into the holes in the beads and sliding the beads to bead stop 49, up to a maximum number of beads that can be fit on hook 43 and yet leave hooked tip 71 exposed. A quantity of filamentous material, such as hair or string, is then hooked in hooked tip 71 near its end. Then the trigger is pulled, and gear segment 66 engages pinion 61, causing it to rotate clockwise along with gear 58. Gear 58 engages rack 47 and causes it to slide rearward into the housing, pulling with it the filamentous material folded over on hooked tip 71 through the holes in the beads. Simultaneously, gear 58 engages gear 59, which turns counterclockwise and engages rack portion 53 of bead stop 49, pushing it and the beads resting against it outward. The combined relative motion of hooked tip 71 and the bead stop 49 towards each other is faster than it would be if only hooked tip 71 or bead stop 49 were moving individually, per distance moved by trigger 63A. This is advantageous because for individuals having small hands, as in children, a smaller trigger movement is needed for a given movement of the hook and thus more beads can be loaded for a given trigger movement.

As trigger 63A is pulled, hooked tip 71 moves through the beads with its hooked filamentous material, and the beads are in effect pushed off the hook, leaving them threaded on the filamentous material. Trigger 63A is then released, and spring 67 forces it back out of handle portion 65, and the action of the hook and bead stop reverses. In practice, the trigger pull can be completed in just a fraction of a second, thus threading the beads in an almost instantaneous manner that is fascinating and easy, providing entertainment value for adults and children alike. Additionally, the handle and trigger make it ergonomically easy to hold for beading items such as someone's hair, and the housing gives it a substantial feel, conceals the parts, and adds visual appeal compared to prior art beading tools. Another advantage is one-handed stringing ability, making it especially suitable for children.

In one embodiment only the hook portion or the bead stop portion can be movable to save expense, and to preserve the same relative movement between the two, the gear ratio can simply be increased. In another embodiment the trigger can be pivoted at a different point, or be made to slide in a track. In yet another embodiment the trigger can be made in many shapes, such as a small button or a wide grip portion the size of the handle. The trigger can connect to the sliding hook or bead stop with any number of well-known linkage means. In other embodiments the housing can be styled in any number of different ways, such as having a handle along the top, along the sides extending horizontally, or the housing can be itself an integral handle.

Figure 13:
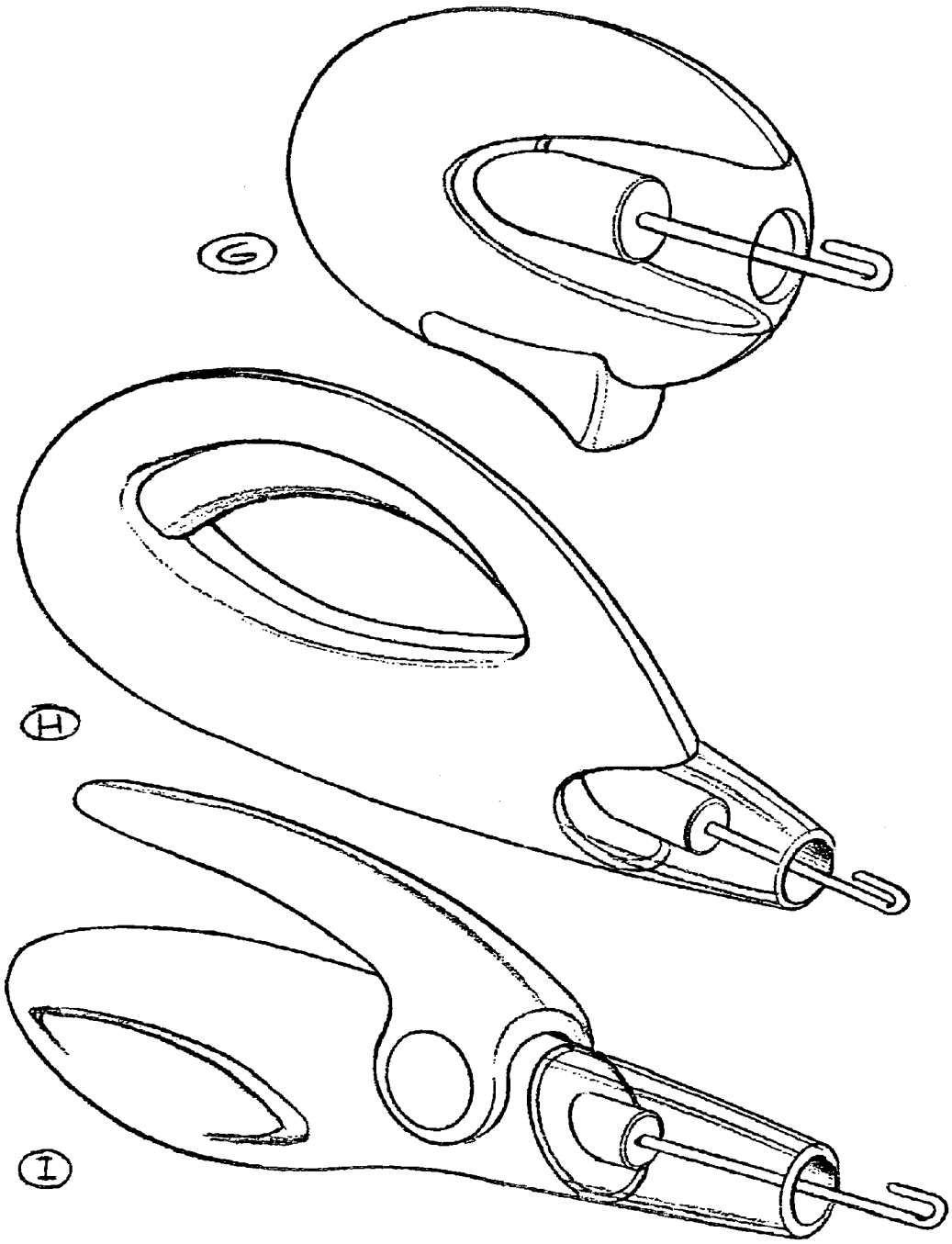
FIG. 13*g* is a perspective view of an embodiment having a handle including a bead shield.
FIG. 13*h* is a perspective view of another embodiment having a handle including a bead shield.
FIG. 13*i* is a perspective view of yet another embodiment having a handle including a bead shield.

FIGS. 13*g–i* illustrate embodiments having different housing styles for beading tools that have the same essential function as the embodiments described above.

FIG. 13*g* illustrates an embodiment having an ovoid shaped body/hook cover combination with a trigger on the bottom.

FIG. 13*h* illustrates an embodiment having a top mounted horizontal handle and enclosed trigger connected at both ends to the housing.

FIG. 13*i* illustrates an embodiment having a top mounted trigger in the form of a large exposed squeeze handle pivoted at its forward end.

Figure 14:
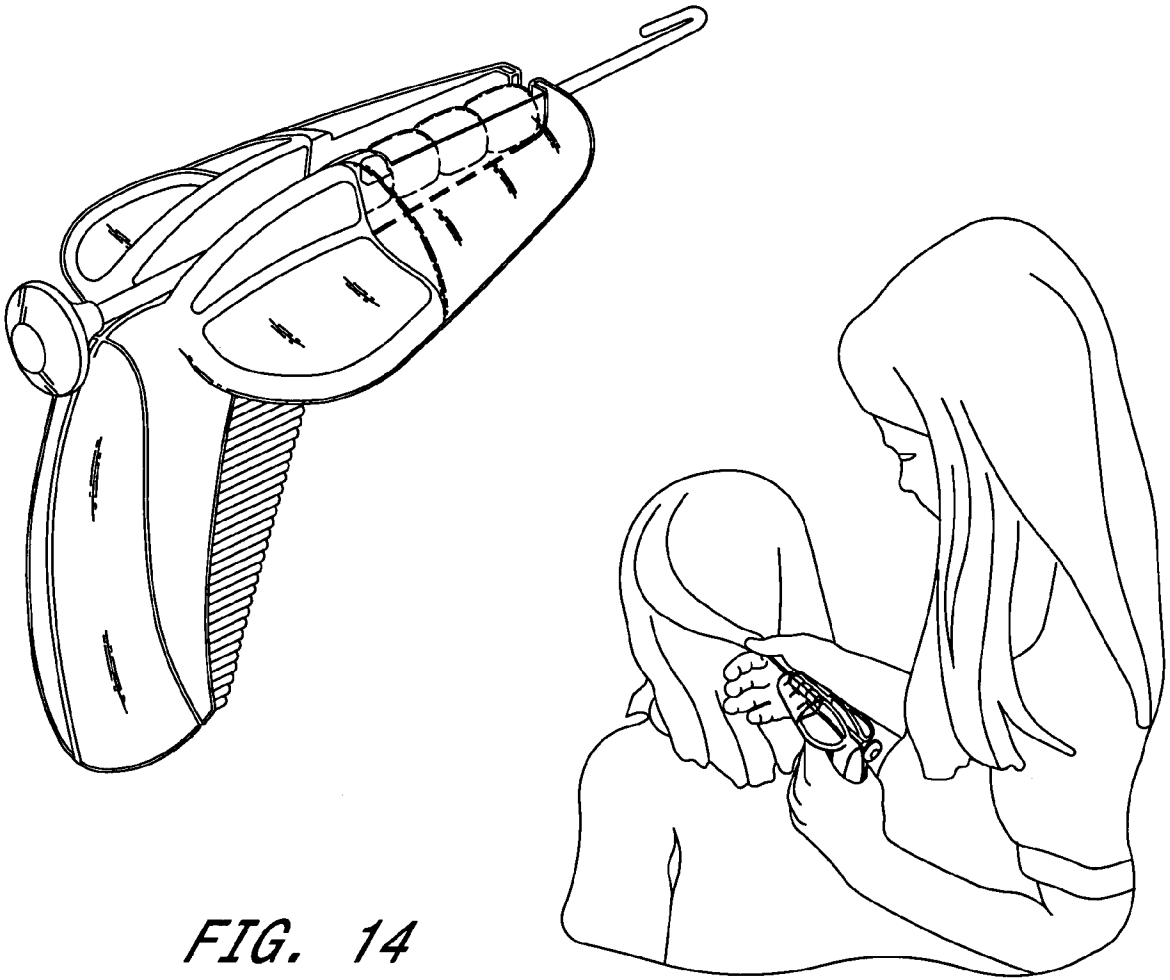
FIG. 14 is a perspective view of an embodiment illustrated in FIG. 4*a* including a bead rest.

Still other embodiments can be made that are different combinations of previously mentioned features. For instance, FIG. 14 illustrates an embodiment having a combination of the embodiment illustrated in FIG. 4*a* with that in FIG. 6. This embodiment shows housing 72 made of a rigid or semi-rigid material, preferably molded plastic, including right and left halves 73 and 74 and forming handle 75 and hook support of the tubular type as previously described (not visible). Hook 76 slides in the hook support portion of the housing and extends forward over bead support 77. In operation, handle 75 is gripped and beads 78 are placed lined-up in bead support 77 with their holes collinear and with hook 76 withdrawn back into the hook support. Knob 79 is then grasped and used to push the hook end of hook 76 through the holes in the lined up row of beads and out the end of the row so that it extends past bead support 77. A portion of filamentous material is then hooked in the end of the hook, and the knob is used to pull the hook with its hooked filamentous material back through the row of beads. As the hook end moves back through the last bead, which has been stopped from moving by the bead stop (not visible), the filamentous material is pulled through the last bead and the row of beads is fully strung and can be lifted out of bead support 77. This stringing motion can be very quick and is more entertaining than in prior art tools where beads must be pushed off a thin part by hand and cannot be prearranged in a desired order on the tool prior to being strung. It is also simpler and thus less expensive than embodiments having triggers and linkages or gears.

Figure 15:
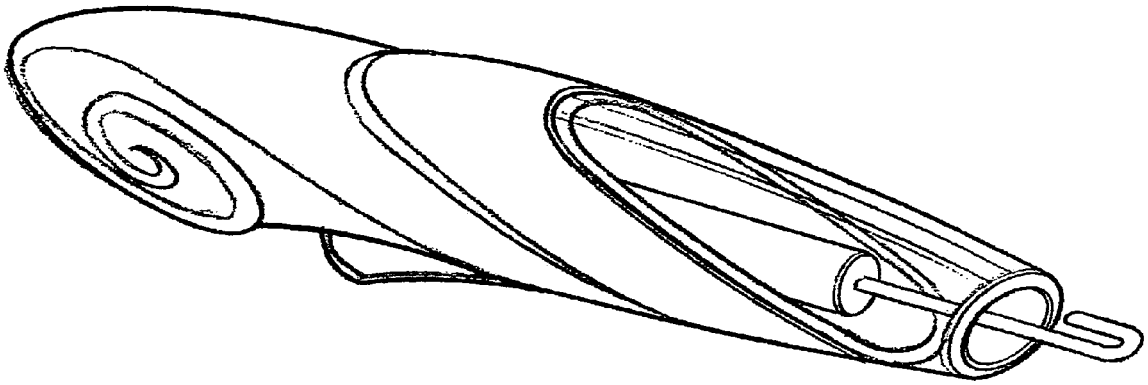
FIG. 15 is a perspective view of an embodiment including a horizontal handle.
Figure 16:
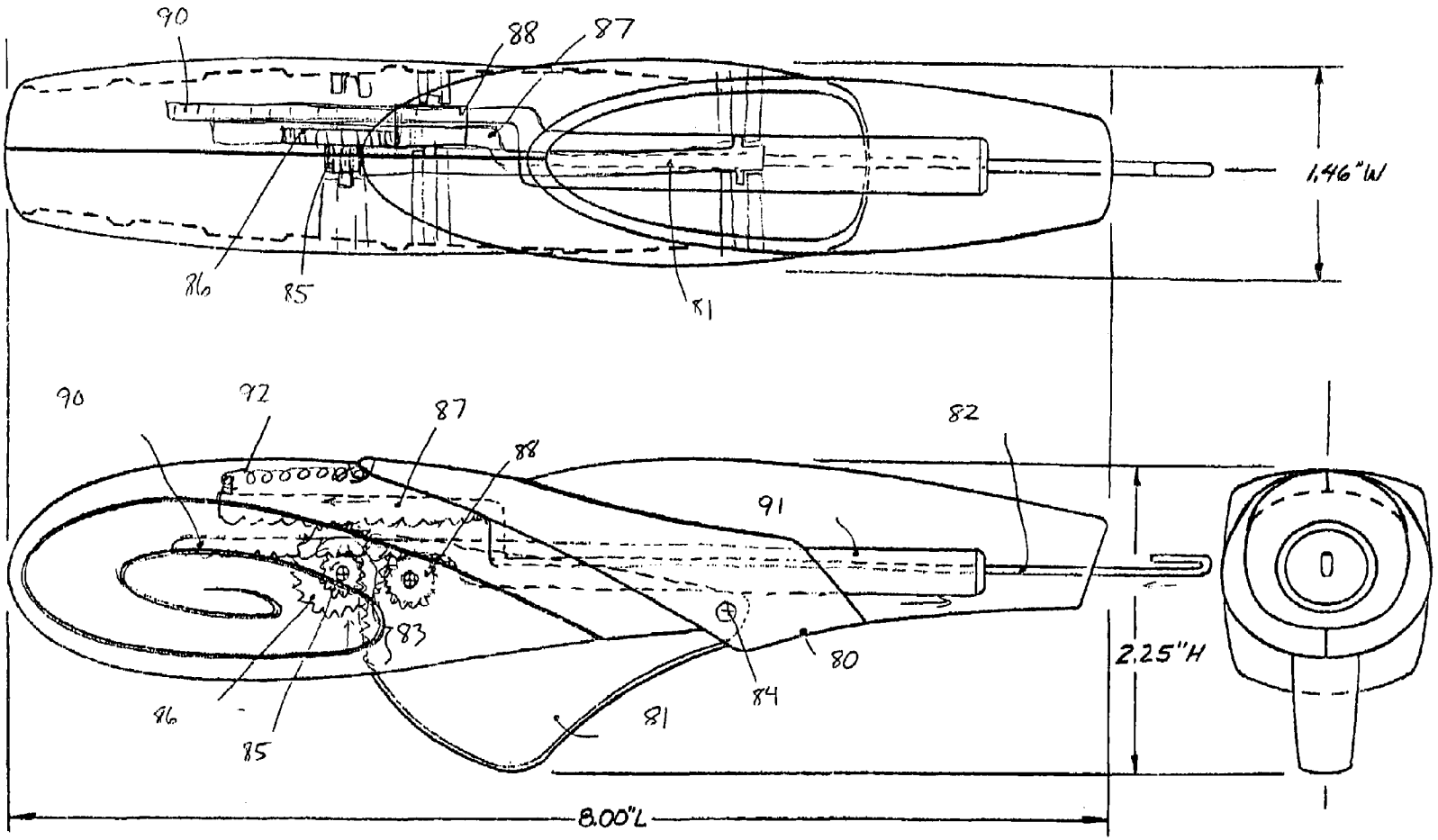
FIG. 16 is a front, top, and side view of the embodiment illustrated in FIG. 15.

FIGS. 15 and 16 illustrate an embodiment having the housing styled as an integral handle. Referring to FIG. 16, it can be seen that the handle is now extending rearward collinearly with the hook, and the trigger now moves upward into the housing. In operation, housing 80 is grasped with trigger 81 un-depressed. Beads (not shown) are placed along hook 82, and filamentous material (not shown) is hooked on hook 82 as previously described. Trigger 81, which is pivotally mounted to housing 80 at pivot 84, is then depressed, and the gear section 83, whose center of rotation is pivot 84, moves upward around pivot 84, engaging pinion 85 and turning it counterclockwise, along with the integral and coaxially attached gear 86. Gear 86 engages hook rack 87, which is slidingly mounted in housing 80, and moves it rearward along with integral hook 82. As hook rack 87 moves to the rear, tension spring 92, which is attached by conventional means to hook rack 87 at one end and to housing 80 at the other, is extended. Gear 86 also engages pinion 88, and rotates it clockwise. Pinion 88 engages bead stop rack 90, which is also slidingly mounted in housing 80, moving rack 90 forward along with integrally attached bead stop 91. As hook 82 moves rearward and bead stop 91 moves forward, the beads are pushed off the hook and are strung on the filamentous material. As trigger 81 is then released, tension spring 92 pulls hook rack 87 forward, which turns engaged pinion 85 and attached gear 86 clockwise, and gear 86 in turn forces engaged pinion 88 and gear 89 to turn counterclockwise and thus force engaged bead stop rack 90 to move rearward, back to its starting position.

It should be noted that other embodiments having other arrangements of gears or linkages to effect the same essential movement without departing from the scope of the invention.

Figure 17:
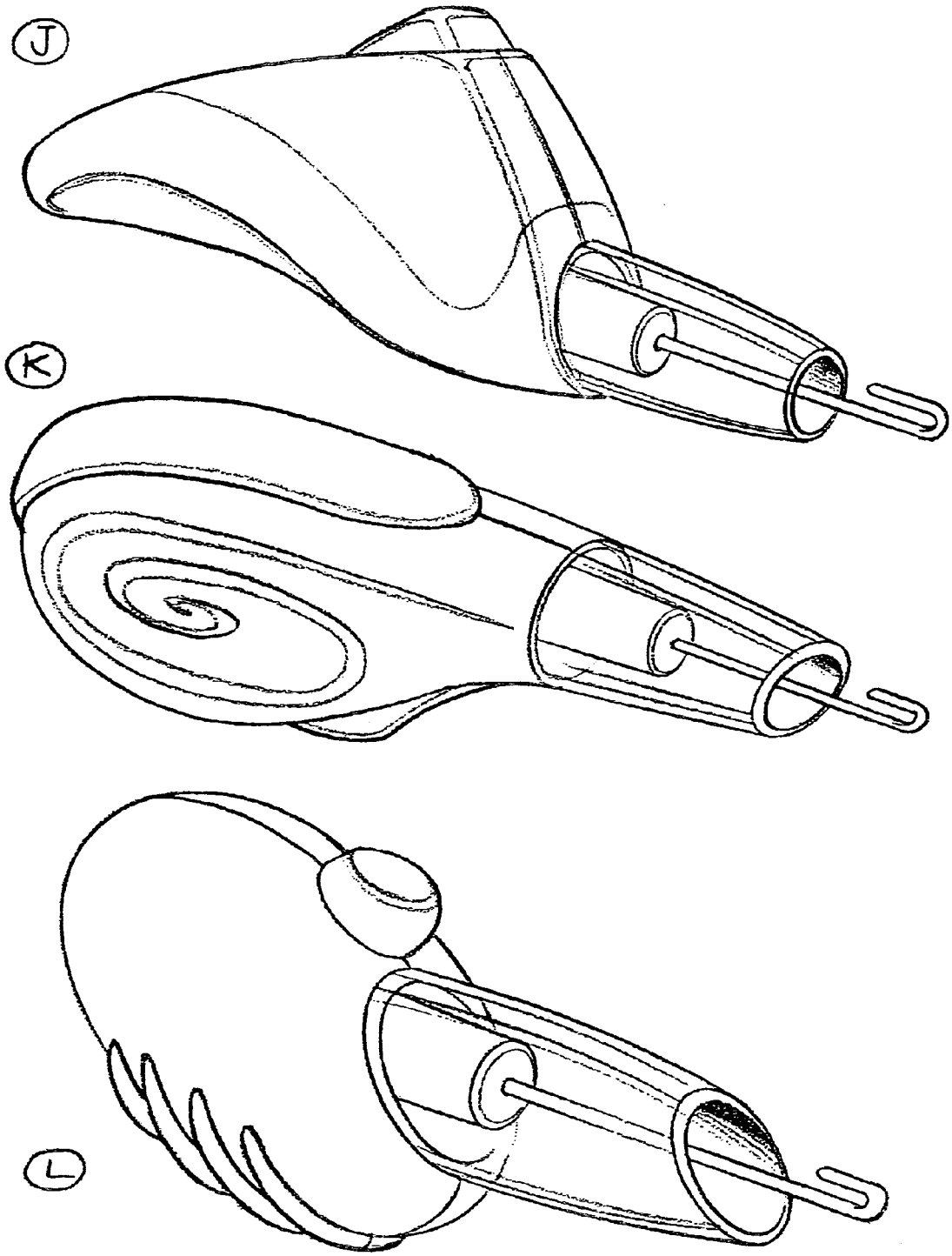
FIG. 17*j* is a perspective view of an embodiment including an integral handle/housing and top mounted trigger.
FIG. 17*k* is a perspective view of another embodiment including an integral handle/housing and top mounted trigger.
FIG. 17*l* is a perspective view of yet another embodiment including an integral handle/housing and top mounted trigger.
Figure 18:
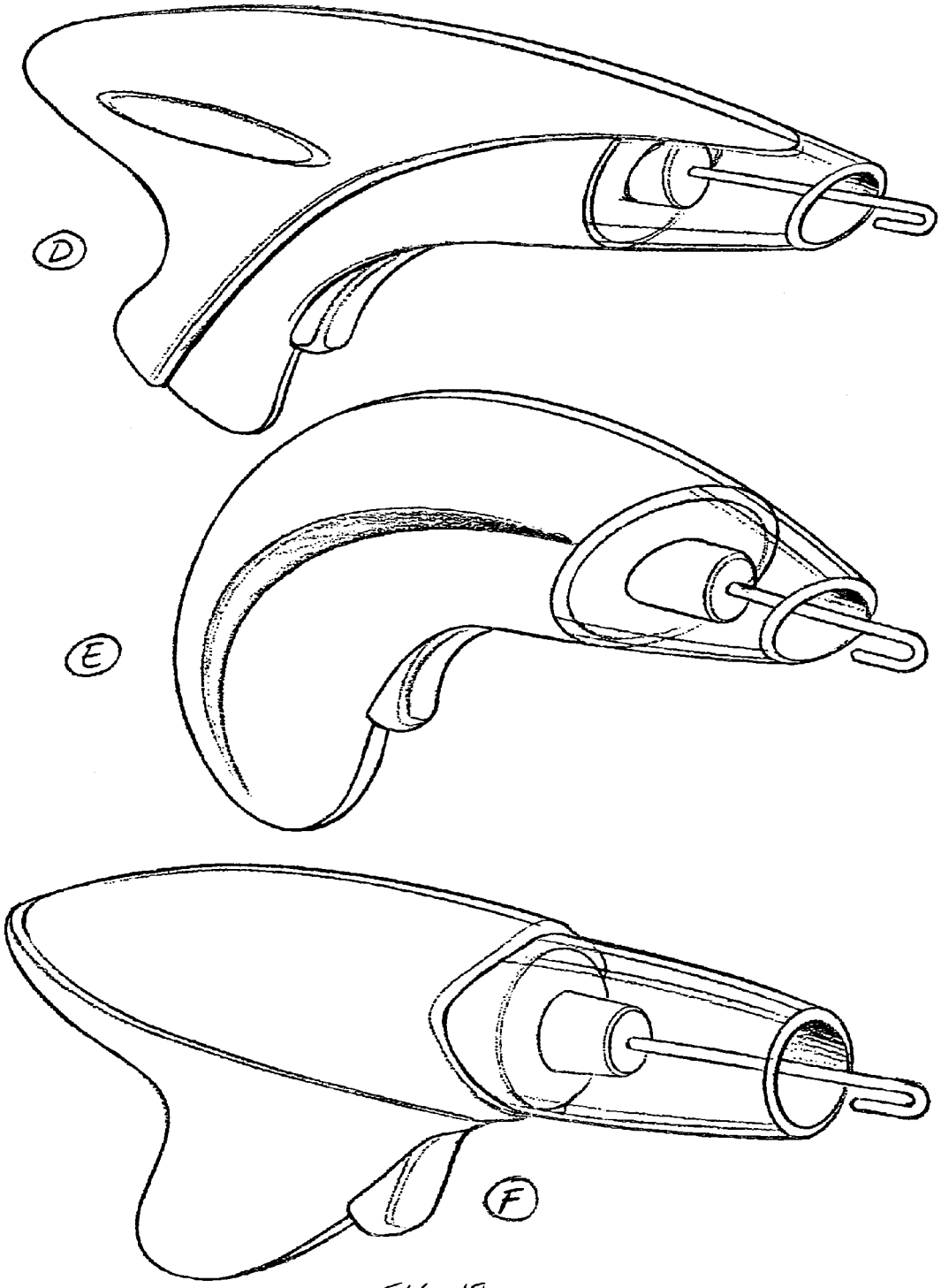
FIG. 18*d* illustrates a perspective view of an embodiment including a pistol handle.
FIG. 18*e* illustrates a perspective view of another embodiment including a pistol handle.
FIG. 18*f* illustrates a perspective view of yet another embodiment including a pistol handle.
Figure 19:
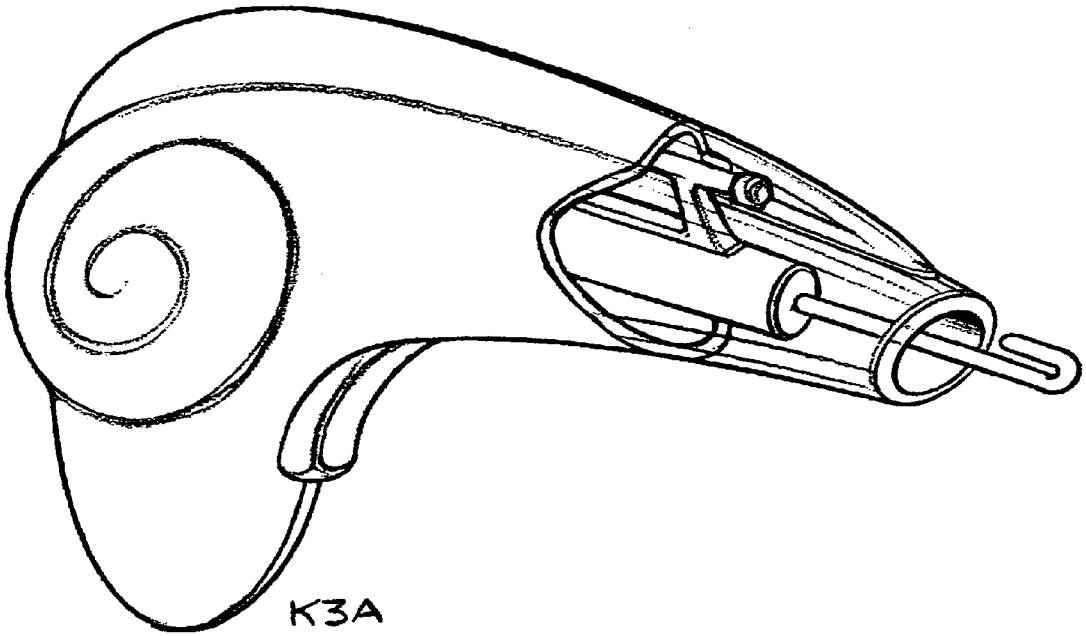
FIG. 19 illustrates a perspective view of another embodiment including a pistol handle.
Figure 19:
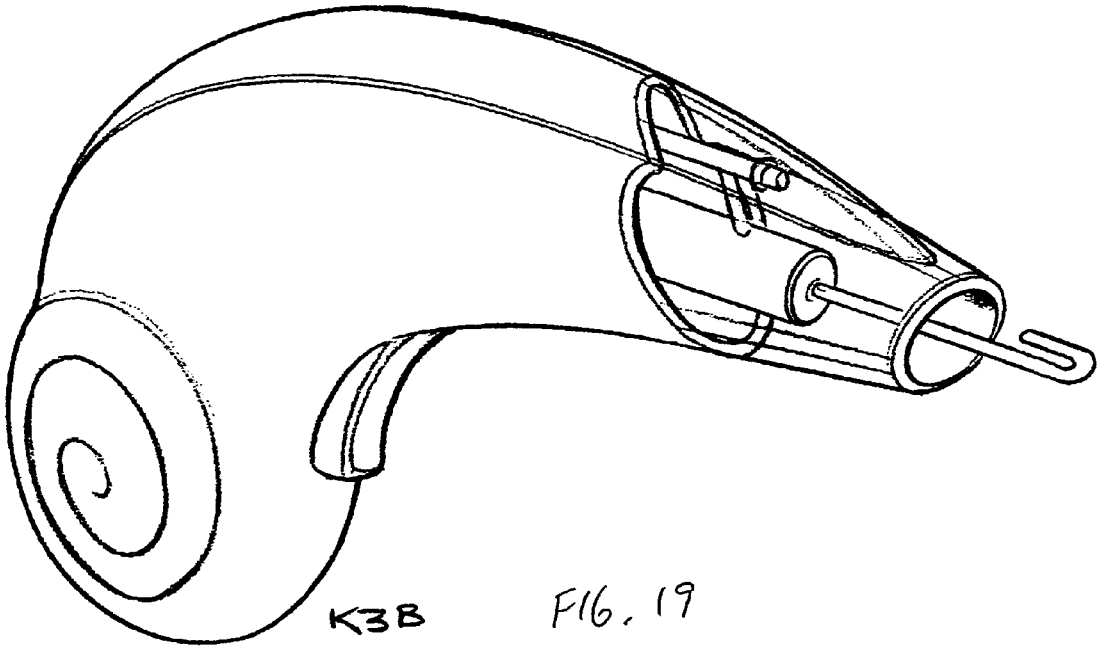
Figure 20:
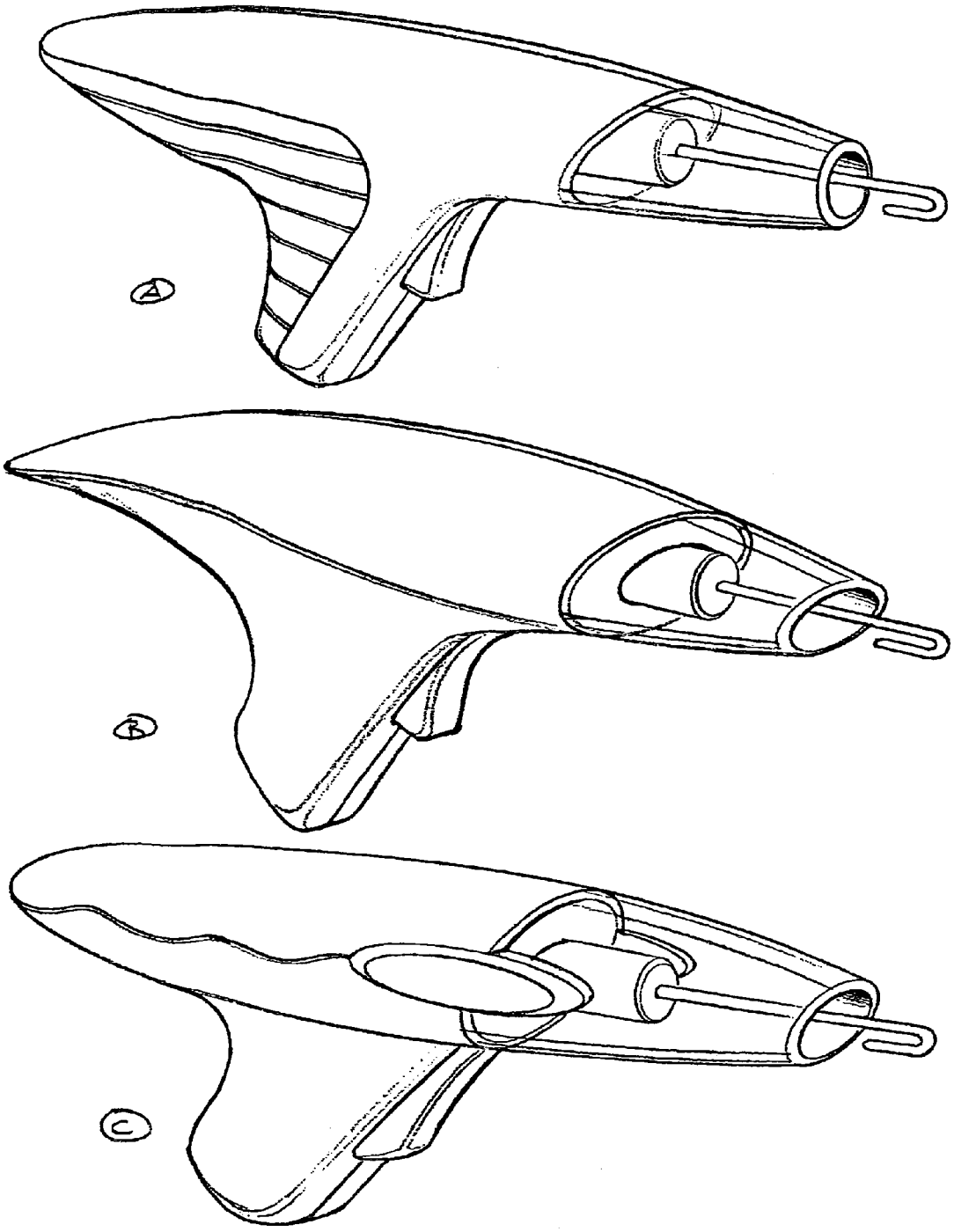
FIG. 20*a–c* illustrate perspective views of still other embodiments including a pistol handle.
Figure 21:
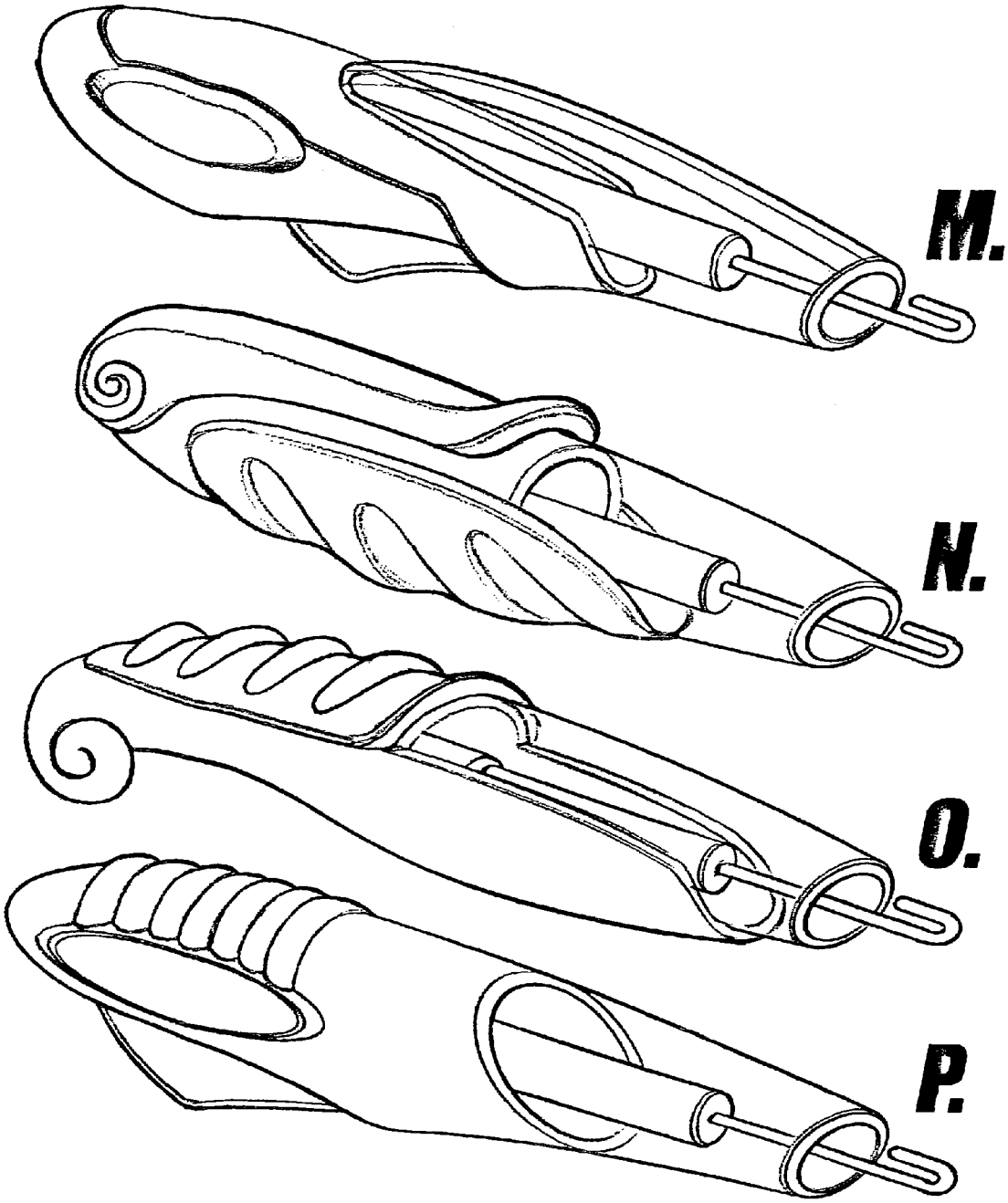
FIG. 21*m* illustrates a perspective view of an embodiment including a horizontal handle and a bottom mounted trigger.
FIG. 21*n* illustrates a perspective view of an embodiment including a horizontal handle and top mounted trigger.
FIG. 21*o* illustrates a perspective view of another embodiment including a horizontal handle and top mounted trigger.
FIG. 21*p* illustrates a perspective view of another embodiment including a horizontal handle and a bottom mounted trigger.

FIGS. 17–21 illustrate other embodiments having varying housing shapes and trigger locations. FIG. 17 illustrates three embodiments in which the trigger is mounted on the top of the housing.

FIGS. 18*d–f*, 19, and 20*a–c* illustrate variously styled embodiments having a pistol-styled handle.

FIGS. 21*m–p* illustrate embodiments having integral horizontal handles, with FIG. 21*n* and *o* illustrating embodiments including a downward-squeezing handle type trigger.

In addition to hand-operated embodiments, the beading tool could also be motorized for even further improved ease of use. In this case, a motor, such as a battery operated electric motor, could be used to replace the mechanical energy imparted in the trigger pull to move the hook in and out of the beads. The motor could also be of many other types, such as a spring motor, electromagnetic actuator, air motor, rubber band motor, piezoelectric motor, shape-memory alloy actuator, or other type. Any number of conventional arrangements can be used to connect the motor to the moving hook and bead stop, such as gears, linkages, or a combination thereof. One embodiment having motorized action is illustrated in FIG. 22.

Figure 12A:
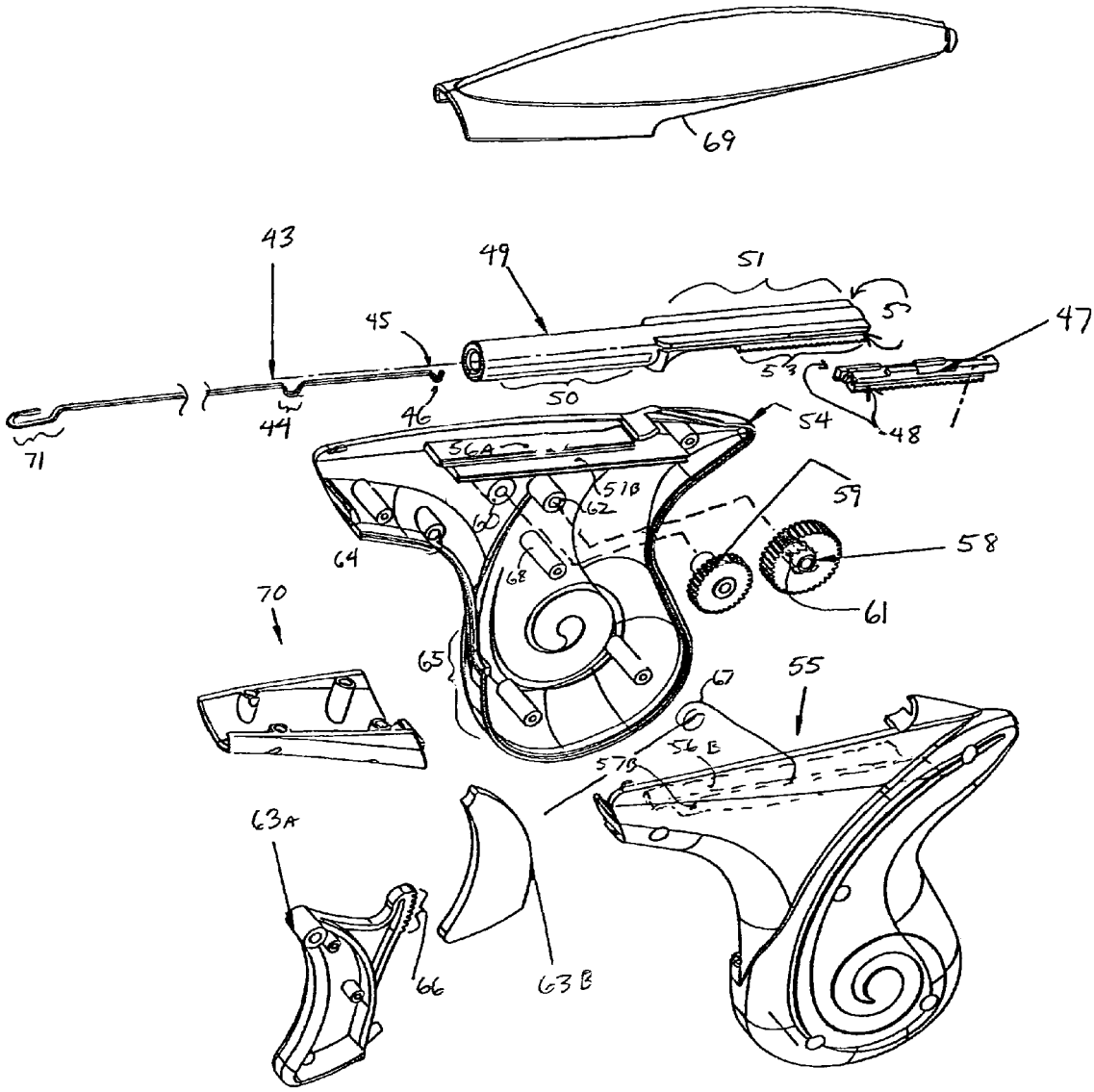
FIG. 12*a* is an exploded view of the embodiment illustrated in FIG. 12.
Figure 12B:
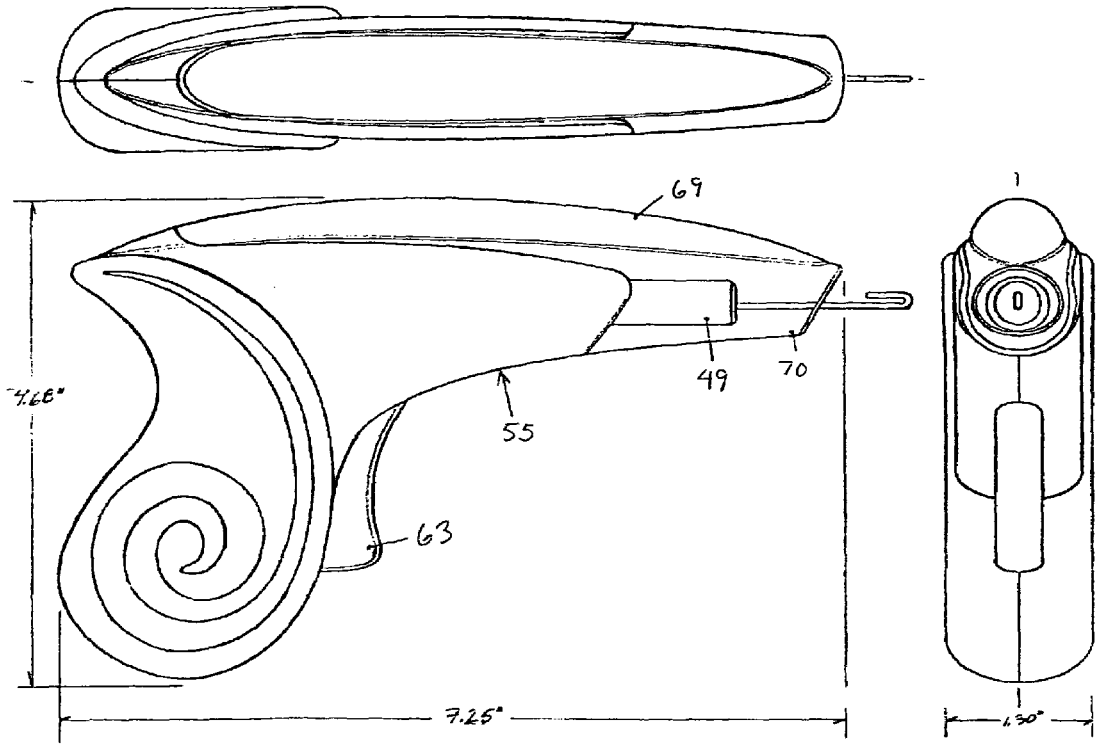
FIG. 12*b* is illustrates an exterior top, side, and front view of the embodiment illustrated in FIG. 12.
Figure 12C:
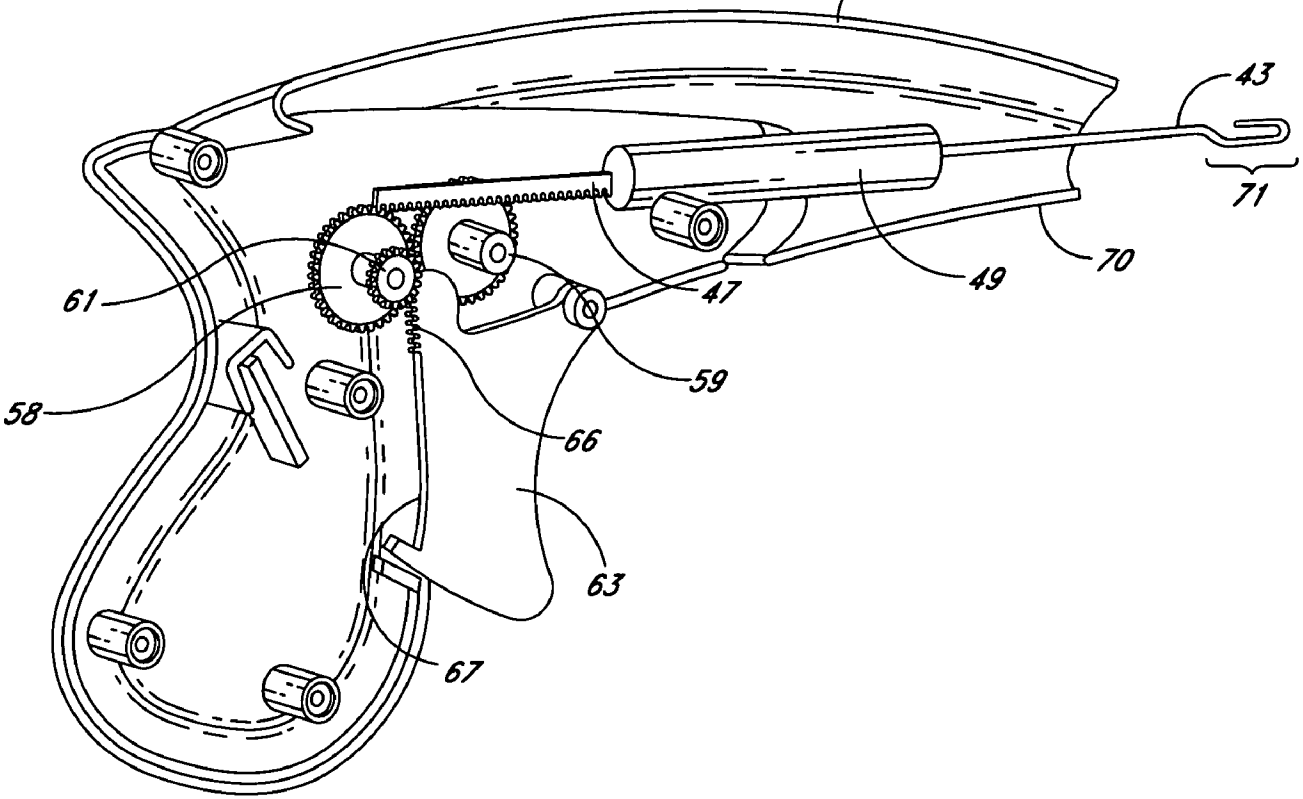
FIG. 12*c* is a perspective cutaway view of the embodiment illustrated in FIG. 12.
Figure 12D:
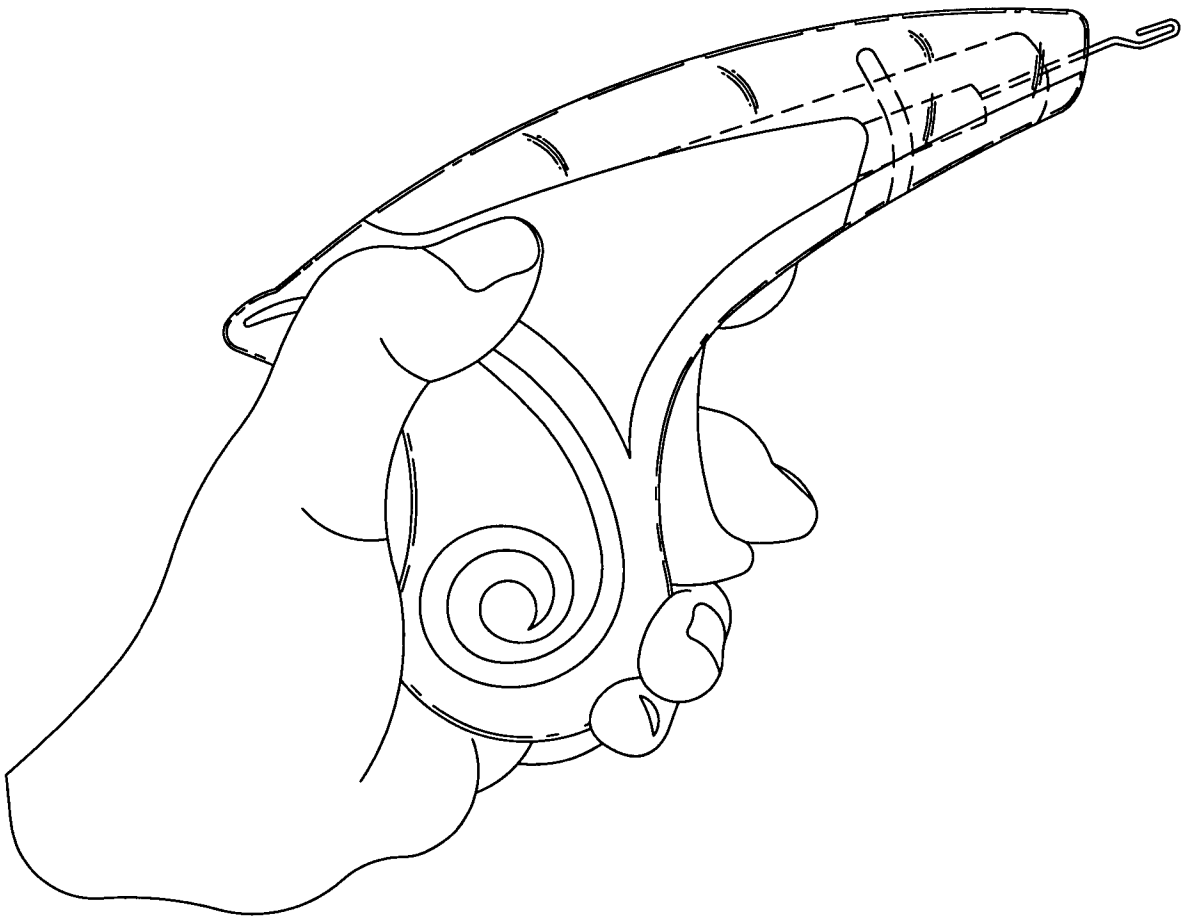
FIG. 12*d* is a photograph an embodiment.
Figure 22:
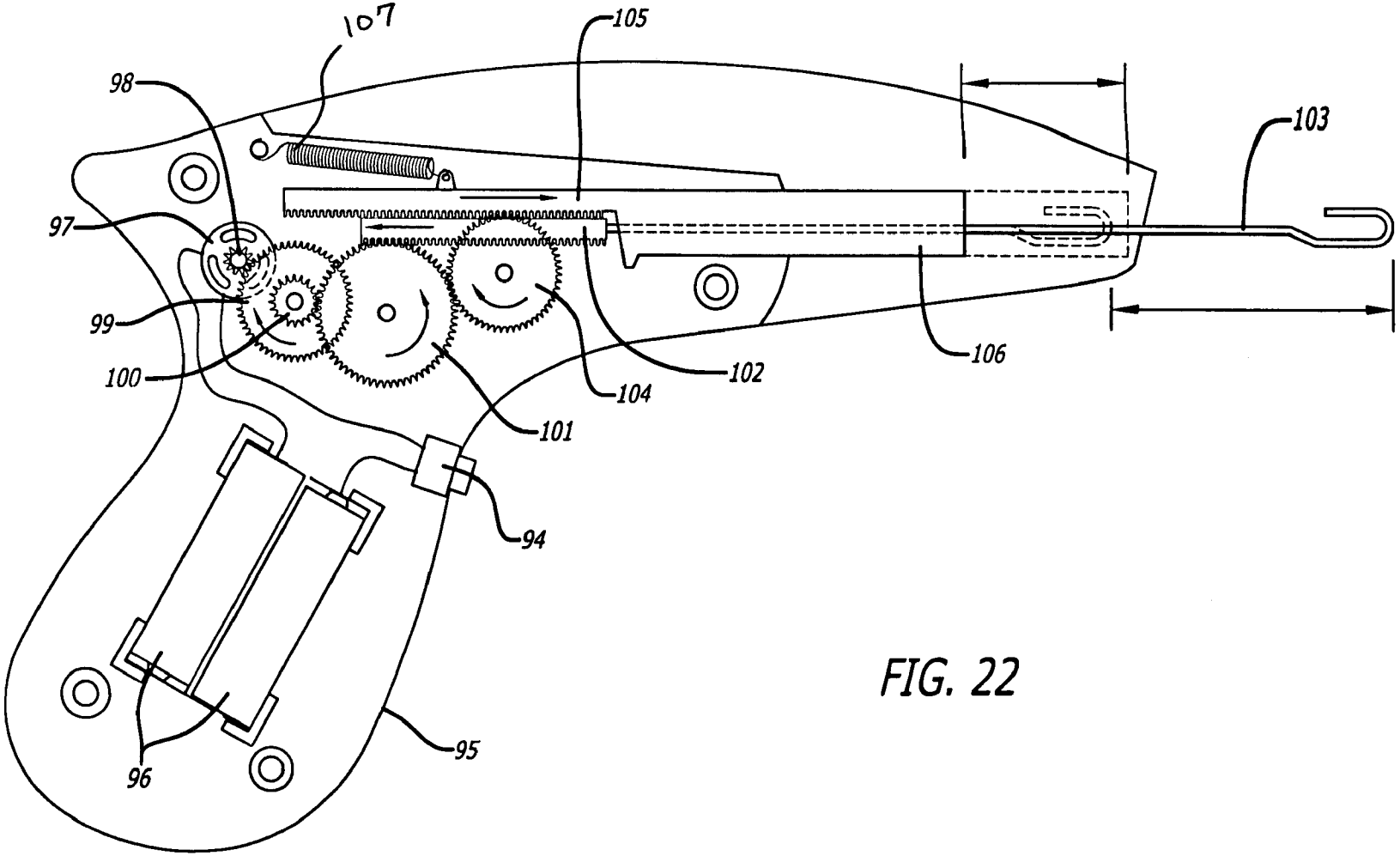
FIG. 22 illustrates a cutaway perspective of a motorized embodiment.

The embodiment illustrated in FIG. 22 is very similar to the embodiment illustrated in FIG. 12*c*, with the mechanical trigger replaced by a switch and an electric motor added to move the hook and bead stop. To operate it, first beads are placed on the hook and filamentous material is hooked as previously described. Then switch 94 is depressed as handle 95 is grasped. This closes a series circuit between batteries 96 and motor 97, causing motor 97 to rotate along with pinion 98 attached to the motor shaft. Pinion 98 engages gear 99, rotating it clockwise as viewed along with coaxially attached pinion 100. Pinion 100 engages gear 101, rotating it counterclockwise. Gear 101 is also engaged with hook rack 102, which moves inward, pulling hook 103 inward. Gear 101 also engages gear 104, which rotates clockwise. Gear 104 is also engaged with bead stop rack 105, which moves outward with bead stop 106. Thus as hook 103 and bead stop 106 move toward each other, any beads placed on the hook will be pushed off and threaded on the filamentous material. When switch 94 is released, spring 107 pulls back bead stop rack 105, and the engaged gear train extends hook 103 out to its original position.

In one embodiment a lighting element (not shown) is coupled to switch 94 and a power supply (i.e., batteries 96). In this embodiment, when switch 94 is closed, the lighting element illuminates. In one embodiment, the lighting element illuminates the beading tool housing. In another embodiment, the lighting element directs light through an opening in the housing to illuminate along the axis of hook 103. The lighting element can be light emitting diodes (LEDs), light bulb(s), a laser type of bulb, etc. In another embodiment, a sensor senses movement of the rod and emits light until the rod returns to its beginning position.

In one embodiment a sound-producing device (not shown) is coupled to switch 94 and a power supply (i.e., batteries 96). The sound-producing device can be any sound-producing device known in the art, such as a sound chip, microchip, etc. In this embodiment, when switch 94 is closed, the sound-producing device emits sound through a speaker coupled to the sound-producing device. The sound-producing device has prerecorded sound. In one embodiment, the sound-producing device has a plurality of different prerecorded sounds. In this embodiment, the different sounds rotate to the next prerecorded sound on each use of the beading tool.

In one embodiment, a lighting element and a sound-producing device (both described above) are included within the housing. In this embodiment, when a switch is closed, both light and sound are emitted from the beading tool.

In one embodiment, the hooked portion of the rod is replaceable. That is, a hooked portion can be replaced with varying sized extension pieces (not shown) that couple to the rod. These extension pieces allow a user to string more beads over a filamentous material. In one embodiment, the hook extension pieces have threaded ends and screw into the rod. In another embodiment, the hook extension pieces snap into place. In another embodiment, the rod is telescopic and can be lengthened to accommodate more beads.

In one embodiment, a bead storage compartment (not shown) is included in the beading tool housing. The bead storage compartment allows a user to keep beads together with the beading tool. In one embodiment, the storage compartment is located on the top of the housing and can be accessed through a lid. The beads can be accessed through the lid by a sliding means, rotating means, or through a hinge coupled to the housing. In one embodiment, the storage compartment is located in the butt of a pistol grip. In another embodiment, the storage compartment is removable and shaped in a magazine clip fashion. In this embodiment, multiple clips can be used to store beads.

In one embodiment a quick bead-loading device (not shown) can be used to decrease the time of loading beads onto the rod. In this embodiment, beads can be poured into the quick bead-loading device and fit in a groove that is sized to hold the beads in a back-to-back order. A bead holding device (e.g., a bar, rubber band, spring, etc.) holds the beads in the quick bead loading device to allow a user to move the device without dropping the beads. The quick bead-loading device can then be held to the rod for loading. When the bead holding device is removed from holding the beads in place, the beads can then be slid onto the rod. In one embodiment, the quick bead-loading device is coupled to a lid on the top of the housing. The lid has a hinge that allows the lid to open to a loading position. The beads can be poured onto the lid and then slid onto the rod.

The above described embodiments are easy to use and very safe to operate. These embodiments have an unusually quick stringing operation, which has a fascinating, almost "magical" quality that also gives it entertainment value, and some embodiments have additional attractive appearances and are comfortable to hold by a user. The ease of use, safety, and entertainment value make the different embodiments suitable for use not only by adults, but also by children.

Some of the features the described embodiments include are as follows: they have a very quick stringing action that provides an almost "magical" quality that is entertaining. They provide a hook support that protects most of the hook from bending or breaking, making it safer for users, especially children. The beads do not need to be pushed on to the string or hair manually. The beads do not need to be pushed on to the string or hair manually. Some embodiments have a stringing action that can be one-handed for further ease of use and entertainment value. Some embodiments have handles that make them easier to hold are substantially attractive in appearance. Some embodiments have a bead support that makes it possible to adjust the order of beads for their aesthetic value without having to remove them from the hook before stringing.

The invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. An apparatus comprising:

a circular and curved rod having a hooked portion disposed within a body portion; and a bead stop coupled to the body portion, wherein said hooked portion adapted to string filamentous material through at least one bead having a thru-hole, said bead stop to force said at least one bead off said rod.

2. The apparatus of claim 1, further comprising a handle coupled to the body portion.

3. The apparatus of claim 1, further including at least one gear coupled to a rack and a trigger, the trigger adapted to rotate the at least one gear.

4. The apparatus of claim 3, further comprising:

a switch coupled to a power supply, and a motor coupled to the at least one gear, wherein the motor is adapted to rotate the at least one gear.

5. The apparatus of claim 1, further comprising one of a light-emitting device, a sound producing device, and a light emitting device and a sound-emitting device.

6. The apparatus of claim 1, further comprising:

a housing, and a storage compartment including a lid, the storage compartment adapted to store a plurality of beads, wherein the lid is one of slidably removable and rotatably removable.

7. The apparatus of claim 6, wherein the storage compartment is removably coupled to the housing.

8. The apparatus of claim 1, further including a quick bead-loading device adapted to hold a plurality of beads in place.

9. The apparatus of claim 1, wherein the rod is stationary and the bead stop is moveable.

10. The apparatus of claim 1, wherein the bead stop is stationary and the rod is moveable.

11. The apparatus of claim 1, wherein the rod and the bead stop are both moveable.

12. An apparatus comprising:

a circular rod having a hooked portion disposed within a body portion;

a handle coupled to the body portion;

at least one gear coupled to a motor, the motor adapted to rotate the at least one gear; and a switch coupled to a power supply and said motor, said power supply and said motor disposed within said handle, wherein said hooked portion adapted to string filamentous material through at least one bead having a thru-hole when said at least one bead is forced off said rod via a bead stop.

13. The apparatus of claim 12, further comprising one of a light-emitting device, a sound producing device, and a light emitting device and a sound-emitting device.

14. The apparatus of claim 12, further comprising:

a housing, and a storage compartment including a lid, the storage compartment adapted to store a plurality of beads, wherein the lid is one of slidably removable and rotatably removable.

15. The apparatus of claim 14, wherein the storage compartment is removably coupled to the housing.

16. The apparatus of claim 12, further including a quick bead-loading device adapted to hold a plurality of beads in place.

17. The apparatus of claim 12, wherein the rod is stationary and the bead stop is moveable.

18. The apparatus of claim 12, wherein the bead stop is stationary and the rod is moveable.

19. The apparatus of claim 12, wherein the rod and the bead stop are both moveable.

20. An apparatus comprising:

a rod having an end portion and a hooked portion, the end portion and the hooked portion being at opposite ends of the rod;

a support coupled to the rod, the support including a plurality of rod guides, and a spring coupled to the rod, the rod having a bent portion to keep the spring in place between the bent portion and one of the plurality of rod guides, wherein said hooked portion adapted to string filamentous material through at least one bead having a thru-hole, and one of the plurality of rod guides is a bead stop adapted to force said at least one bead off said rod.

21. The apparatus of claim 20, further including a trigger coupled to the spring, wherein the trigger is adapted to compress the spring to move the rod.

22. The apparatus of claim 21, further including a trigger link coupled to the trigger and the rod.

23. The apparatus of claim 21, further including at least one gear coupled to a rack and the trigger, the trigger adapted to rotate the at least one gear.

24. The apparatus of claim 23, further comprising:

a switch coupled to a power supply and a motor, and at least one gear coupled to the motor, wherein the motor is adapted to rotate the at least one gear.

25. An apparatus comprising:

a rod having an end portion and a hooked portion, the end portion and the hooked portion being at opposite ends of the rod;

a support coupled to the rod, the support including a plurality of rod guides;

a cylinder surrounding the rod; and one of a light-emitting device, a sound producing device, and a light emitting device and a sound-emitting device, wherein said hooked portion adapted to string filamentous material through at least one bead having a thru-hole, and the rod is slidable within the cylinder.

26. The apparatus of claim 25, further including a pistol handle coupled to the cylinder.

27. The apparatus of claim 26, further including a rod cover coupled to one end of the cylinder, wherein the rod cover is one of transparent and translucent.

28. An apparatus comprising:

a rod having an end portion and a hooked portion, the end portion and the hooked portion being at opposite ends of the rod;

a support coupled to the rod, the support including a plurality of rod guides;

a cylinder surrounding the rod, wherein the rod is slidable within the cylinder;

a housing; and a storage compartment including a lid, the storage compartment adapted to store a plurality of beads, wherein the lid is one of slidably removable and rotatably removable, and said hooked portion adapted to string filamentous material through at least one bead having a thru-hole.

29. The apparatus of claim 28, wherein the storage compartment is removably coupled to the housing.

30. The apparatus of claim 28, further including a quick bead-loading device adapted to hold a plurality of beads in place.

31. An apparatus comprising:

a rod having an end portion, a hooked portion and a circular portion, the end portion and the hooked portion being at opposite ends of the rod;

a hook support coupled to the rod, the support including a plurality of rod guides, a tab coupled to the rod, the tab adapted to rotate the rod through a bead stop;

a spring coupled to the rod, the rod having a bent portion to keep the spring in place between the bent portion and one of the plurality of rod guides, wherein said hooked portion adapted to string filamentous material through at least one bead having a thru-hole.

32. The apparatus of claim 31, further including a trigger coupled to the spring, wherein the trigger is adapted to compress the spring to move the rod.

33. The apparatus of claim 32, further including a trigger link coupled to the trigger and the rod.

34. The apparatus of claim 32, further including at least one gear coupled to a rack and the trigger, the trigger adapted to rotate the at least one gear.

35. The apparatus of claim 34, further comprising:

a switch coupled to a power supply, and a motor coupled to the at least one gear, wherein the motor is adapted to rotate the at least one gear to move the rod.

36. An apparatus comprising:

a rod having an end portion, a hooked portion and a circular portion, the end portion and the hooked portion being at opposite ends of the rod;

a hook support coupled to the rod, the support including a plurality of rod guides;

a tab coupled to the rod, the tab adapted to rotate the rod through a bead stop; and one of a light-emitting device, a sound producing device, and a light emitting device and a sound-emitting device, wherein said hooked portion adapted to string filamentous material through at least one bead having a thru-hole.

37. The apparatus of claim 36, further including a quick bead-loading device adapted to hold a plurality of beads in place.

38. An apparatus comprising:

a rod having an end portion, a hooked portion and a circular portion, the end portion and the hooked portion being at opposite ends of the rod;

a hook support coupled to the rod, the support including a plurality of rod guides;

a tab coupled to the rod, the tab adapted to rotate the rod through a bead stop;

a housing; and a storage compartment including a lid, the storage compartment adapted to store a plurality of beads, wherein the lid is one of slidably removable and rotatably removable.

39. The apparatus of claim 38, wherein the storage compartment is removably coupled to the housing.

40. The apparatus of claim 38, further including a quick bead-loading device adapted to hold a plurality of beads in place.

41. An apparatus comprising:

a rod having an end portion and a hooked portion, the end portion and the hooked portion being at opposite ends of the rod, the rod slidably coupled to a cylinder;

a housing coupled to the cylinder, the housing including a plurality of axles disposed within said housing, a plurality of gears coupled to a trigger;

a gear rack coupled to the cylinder; and one of a light-emitting device, a sound producing device, and a light emitting device and a sound-emitting device, wherein said hooked portion adapted to string filamentous material through at least one bead having a thru-hole, and said hooked portion adapted to string filamentous material through at least one bead having a thru-hole.

42. The apparatus of claim 41, wherein the housing includes a handle.

43. The apparatus of claim 42, wherein the handle has a pistol grip.

44. The apparatus of claim 41, further including a spring coupled to the rod.

45. The apparatus of claim 41, further comprising:

a switch coupled to a power supply, and a motor coupled to the plurality of gears, wherein the motor is adapted to rotate the plurality of gears.

46. The apparatus of claim 41, further comprising:

a storage compartment including a lid, the storage compartment adapted to store a plurality of beads, wherein the lid is one of slidably removable and rotatably removable.

47. The apparatus of claim 46, wherein the storage compartment is removably coupled to the housing.

48. The apparatus of claim 41, further including a quick bead-loading device adapted to hold a plurality of beads in place.

49. An apparatus comprising:

a rod having an end portion and a hooked portion, the end portion and the hooked portion being at opposite ends of the rod, the rod slidably coupled to a cylinder;

a housing coupled to the cylinder, the housing including a plurality of axles disposed within said housing, a plurality of gears coupled to a trigger;

a gear rack coupled to the cylinder; and a storage compartment including a lid, the storage compartment adapted to store a plurality of beads, wherein the lid is one of slidably removable and rotatably removable, and said hooked portion adapted to string filamentous material through at least one bead having a thru-hole.

50. The apparatus of claim 49, wherein the storage compartment is removably coupled to the housing.

51. A method comprising:

sliding at least one bead onto a rod having a hook portion;

hooking a section of filamentous material over the hook portion; and threading the at least one bead onto the filamentous material, wherein said threading the at least one bead onto the filamentous material is completed by moving a bead stop and forcing said at least one bead off said rod.

52. The method of claim 51, wherein the forcing said at least one bead off said rod activated by pulling a trigger coupled to the rod.

53. The method of claim 51, wherein the forcing said at least one bead off said rod activated by closing a switch coupled to a motor.

54. The method of claim 51, wherein the rod is one of straight or curved.

55. A method comprising:

sliding at least one bead onto a rod having a hook portion;

hooking a section of filamentous material over the hook portion;

threading the at least one bead onto the filamentous material, wherein said threading the at least one bead onto the filamentous material is completed by moving said rod through a bead stop and forcing said at least one bead off said rod.

56. The method of claim 55, wherein the moving said rod through said bead stop is activated by pulling a trigger coupled to the rod.

57. The method of claim 55, wherein the moving said rod through said bead stop is activated by closing a switch coupled to a motor.

58. The method of claim 55, wherein the rod is one of straight or curved.

59. A method comprising:

sliding at least one bead onto a rod having a hook portion;

hooking a section of filamentous material over the hook portion;

threading the at least one bead onto the filamentous material, wherein said threading the at least one bead onto the filamentous material is completed by moving said rod toward a bead stop and moving said bead stop toward said rod and forcing said at least one bead off said rod.

60. The method of claim 59, wherein the moving said rod toward the bead stop and moving said bead stop toward said rod is activated by pulling a trigger coupled to the rod.

61. The method of claim 59, wherein the moving said rod toward the bead stop and moving said bead stop toward said rod is activated by closing a switch coupled to a motor.

62. The method of claim 59, wherein the moving said rod toward the bead stop and moving said bead stop toward said rod is activated by using a quick bead loading device.

63. The method of claim 59, wherein the rod is one of straight or curved.

* * * * *